US011785403B2

(12) United States Patent
Dahl et al.

(10) Patent No.: US 11,785,403 B2
(45) Date of Patent: Oct. 10, 2023

(54) DEVICE TO OPTICALLY VERIFY CUSTOM HEARING AID FIT AND METHOD OF USE

(71) Applicant: Starkey Laboratories, Inc., Eden Prairie, MN (US)

(72) Inventors: Brian Thomas Dahl, Minnetrista, MN (US); Julian Taylor Struksheats, St. Paul, MN (US); Westley Gordon Gentry, Buffalo, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 0 days.

(21) Appl. No.: 17/463,119

(22) Filed: Aug. 31, 2021

(65) Prior Publication Data

US 2022/0070596 A1 Mar. 3, 2022

Related U.S. Application Data

(60) Provisional application No. 63/072,816, filed on Aug. 31, 2020.

(51) Int. Cl.
*H04R 25/00* (2006.01)

(52) U.S. Cl.
CPC ..... *H04R 25/652* (2013.01); *H04R 25/30* (2013.01); *H04R 25/658* (2013.01)

(58) Field of Classification Search
CPC ..... H04R 25/652; H04R 25/30; H04R 25/658
USPC ..... 381/328
See application file for complete search history.

(56) References Cited

U.S. PATENT DOCUMENTS

| | | | | |
|---|---|---|---|---|
| 4,652,414 | A * | 3/1987 | Schlaegel | H04R 25/652 264/222 |
| 5,318,853 | A * | 6/1994 | Bayha | C09J 167/06 525/445 |
| 7,162,323 | B2 | 1/2007 | Brumback et al. | |
| 8,638,964 | B2 | 1/2014 | Vaarbroe et al. | |
| 9,654,884 | B2 | 5/2017 | Hug et al. | |
| 9,848,273 | B1 | 12/2017 | Helwani et al. | |
| 2009/0296202 | A1 * | 12/2009 | Wei | G02B 5/208 359/359 |
| 2010/0328678 | A1 * | 12/2010 | Kagermeier | A61B 5/6817 356/601 |
| 2012/0068379 | A1 | 3/2012 | Klemenz et al. | |

(Continued)

FOREIGN PATENT DOCUMENTS

WO 2013020851 2/2013

OTHER PUBLICATIONS

"Custom Products Operations Manual," Starkey Hearing Technologies Manual 2019 (23 pages).

(Continued)

*Primary Examiner* — Phylesha Dabney
(74) *Attorney, Agent, or Firm* — Pauly, DeVries Smith & Deffner LLC

(57) ABSTRACT

Embodiments herein relate to a test shell for assessing fit in an ear of a user of an ear-wearable device, such as a hearing aid. The test shell includes a body having an aperture end and an ear canal end, the aperture end defines a first aperture, and the body defines a shell cavity extending away from the first aperture in a direction of the ear canal end. The body includes a transparent or translucent material and is sized to fit within an ear of the user of an ear-wearable device. Other embodiments are also included herein.

20 Claims, 15 Drawing Sheets

(56) References Cited

U.S. PATENT DOCUMENTS

| | | | | |
|---|---|---|---|---|
| 2017/0292026 | A1* | 10/2017 | Zhang | C08F 212/08 |
| 2017/0305039 | A1 | 10/2017 | Schreiner | |
| 2018/0317837 | A1 | 11/2018 | Burwinkel et al. | |
| 2018/0343527 | A1 | 11/2018 | Edwards | |

OTHER PUBLICATIONS

Pirzanski, Chester, et al. "If you blame buffing for bad fittings, you've probably given the wrong impression," The Hearing Journal, vol. 57, No. 2, Feb. 2004, pp. 40-45 (4 pages).

* cited by examiner

DEVICE TO OPTICALLY VERIFY CUSTOM HEARING AID FIT AND METHOD OF USE

This application claims the benefit of U.S. Provisional Application No. 63/072,816, filed Aug. 31, 2020, the content of which is herein incorporated by reference in its entirety.

FIELD

Embodiments herein relate to a device, system and method for creating a shell structure and assessing fit of the shell structure, where the shell structure will form part of a housing for an in-ear, ear-wearable device, such as a hearing aid.

SUMMARY

In a first aspect, a test shell for assessing fit in an ear of a user of an ear-wearable device includes a body having an aperture end and an ear canal end. The aperture end defines a first aperture. The body defines a shell cavity extending away from the first aperture in a direction of the ear canal end, includes a transparent or translucent material, and is sized to fit within an ear of the user of an ear-wearable device.

In a second aspect, in addition to one or more of the preceding or following aspects, or in the alternative to some aspects, the body includes a light-sensitive material, wherein the light-sensitive material displays, when exposed to light, a visual contrast to a human eye between test shell portions contacting the user's ear and test shell portions not contacting the user's ear when illuminated.

In a third aspect, in addition to one or more of the preceding or following aspects, or in the alternative to some aspects, the light-sensitive material is sensitive to visual light, ultraviolet light, or infrared light.

In a fourth aspect, in addition to one or more of the preceding or following aspects, or in the alternative to some aspects, the test shell further includes an indication of ear anatomy of the user on a surface of the test shell.

In a fifth aspect, in addition to one or more of the preceding or following aspects, or in the alternative to some aspects, the ear canal end defines a second aperture, wherein the shell cavity extends from the first aperture to the second aperture.

In a sixth aspect, in addition to one or more of the preceding or following aspects, or in the alternative to some aspects, the body includes acrylic, UV cured acrylic, polyurethane, or glass.

In a seventh aspect, in addition to one or more of the preceding or following aspects, or in the alternative to some aspects, the body includes a material having a light transmission percentage of about 85% or more.

In an eighth aspect, in addition to one or more of the preceding or following aspects, or in the alternative to some aspects, the body includes a body wall having a thickness of 0.2 millimeter or more and 1.5 millimeter or less.

In a ninth aspect, in addition to one or more of the preceding or following aspects, or in the alternative to some aspects, the body includes a material having a tensile strength of at least about 55 megapascals.

In a tenth aspect, in addition to one or more of the preceding or following aspects, or in the alternative to some aspects, the body includes a pressure-sensitive color changing material that changes color in response to pressure and is present on an exterior surface of test shell.

In an eleventh aspect, a method of fitting a user with an ear-wearable device includes creating an impression of the user's ear using an impression material and creating a test shell using the impression. The test shell includes a body having an aperture end and an ear canal end, wherein the aperture end defines a first aperture, wherein the body defines a shell cavity extending away from the first aperture in a direction of the ear canal end. The body includes a transparent or translucent material and is sized to fit within an ear of the user of an ear-wearable device. The method further includes placing the test shell into the user's ear and illuminating the test shell, while the test shell is in the user's ear, using a light source placed within the shell cavity. The method further includes visually inspecting the test shell, while the test shell is in the user's ear, using a light source to evaluate goodness of fit of the test shell in the user's ear.

In a twelfth aspect, in addition to one or more of the preceding or following aspects, or in the alternative to some aspects, the method includes recording a first user observation at a first-time regarding goodness of fit during moving by the user, wherein the user observations include comfort, discomfort, locations of discomfort, occlusion, lack of occlusion, or locations of lack of occlusion. The method further includes creating a final shell for an ear-wearable device using the first user observation and using information recorded based on visually inspecting the test shell.

In a thirteenth aspect, in addition to one or more of the preceding or following aspects, or in the alternative to some aspects, the method further can include recording a second user observation at a second time, wherein the second time is at least one day later than the first time, wherein creating the final shell further includes using the second user observation.

In a fourteenth aspect, in addition to one or more of the preceding or following aspects, or in the alternative to some aspects, the method includes recording the first user observation takes place after moving by the user, where moving by the user can include chewing, talking, walking, swallowing, or yawning by the user.

In a fifteenth aspect, in addition to one or more of the preceding or following aspects, or in the alternative to some aspects, the method further can include constructing a final shell for the ear-wearable device using information recorded based on visually inspecting the test shell.

In a sixteenth aspect, in addition to one or more of the preceding or following aspects, or in the alternative to some aspects, the method further can include capturing an image of the shell cavity of the test shell when the test shell is in the user's ear.

In a seventeenth aspect, in addition to one or more of the preceding or following aspects, or in the alternative to some aspects, the method further can include moving by the user while the test shell is in the user's ear, such as chewing, talking, walking, swallowing or yawning by the user. The method can further include visually inspecting, while the test shell is in the user's ear, the test shell during the moving by the user, and recording a first user observation regarding goodness of fit during moving by the user, wherein the first user observation includes an observation regarding comfort, discomfort, locations of discomfort, occlusion, lack of occlusion, or locations of lack of occlusion.

In an eighteenth aspect, in addition to one or more of the preceding or following aspects, or in the alternative to some aspects, the method further can include video recording of the shell cavity of the test shell, while the test shell is in the user's ear, during moving by the user.

In a nineteenth aspect, in addition to one or more of the preceding or following aspects, or in the alternative to some aspects, the test shell and the final shell are made of material having a tensile strength of at least about 55 megapascals.

In a twentieth aspect, a test shell for assessing fit in an ear of a user of an ear-wearable device includes a body having an aperture end and an ear canal end, wherein the aperture end defines a first aperture, wherein the body defines a shell cavity extending away from the first aperture in a direction of the ear canal end. The body includes a transparent or translucent material and includes a color-changing material that changes color in response to pressure or temperature. The body is sized to fit within an ear of the user of an ear-wearable device.

This summary is an overview of some of the teachings of the present application and is not intended to be an exclusive or exhaustive treatment of the present subject matter. Further details are found in the detailed description and appended claims. Other aspects will be apparent to persons skilled in the art upon reading and understanding the following detailed description and viewing the drawings that form a part thereof, each of which is not to be taken in a limiting sense. The scope herein is defined by the appended claims and their legal equivalents.

BRIEF DESCRIPTION OF THE FIGURES

Aspects may be more completely understood in connection with the following figures (FIGS.), in which.

Figure 1:
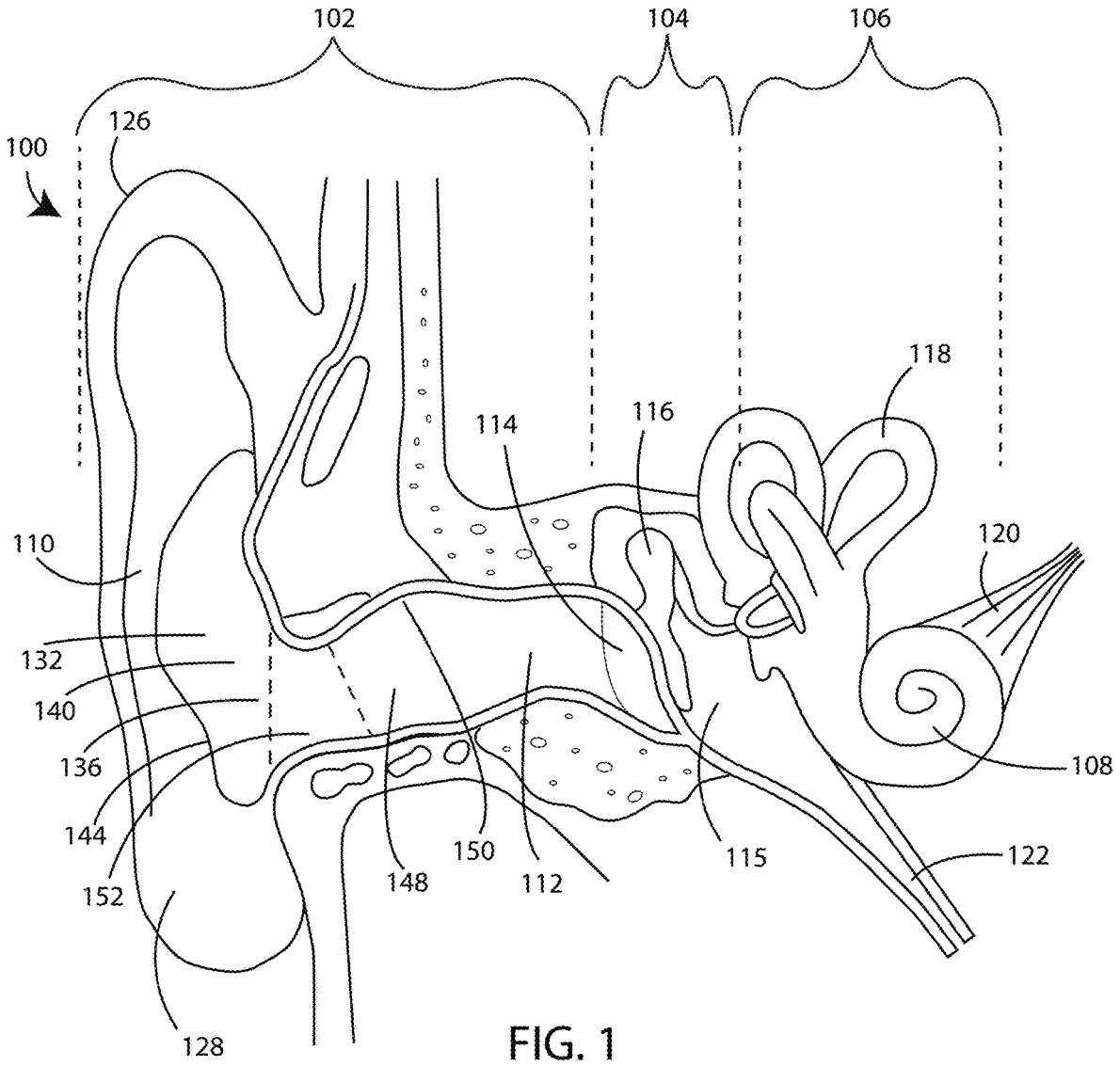
FIG. 1 is a partial cross-sectional view of ear anatomy.

While embodiments are susceptible to various modifications and alternative forms, specifics thereof have been shown by way of example and drawings, and, will be described in detail. It should be understood, however, that the scope herein is not limited to the particular aspects described. On the contrary, the intention is to cover modifications, equivalents, and alternatives falling within the spirit and scope herein.

DETAILED DESCRIPTION

A test shell and method of fitting a user for an ear-wearable device described herein enables a pathway for feedback during the modeling process for a final shell that will improve the fit of the final shell for an ear-wearable device. The test shell is made of a transparent or translucent material to allow inspection of the fit in the user's ear by a caregiver before a final shell is manufactured. In some examples, the test shell and methods have additional features that allow gathering detailed fit information before a final test shell is manufactured.

A custom ear-wearable device, such as a custom hearing aid, is made by creating a one-of-a-kind shell that fits the exact ear anatomy of the user for optimal comfort and performance. Examples of non-custom ear-wearable devices include behind-the-ear (BTE) and receiver-in-canal (RIC) hearing aids, which both have a housing that fits behind the user's ear. Many examples of custom ear-wearable devices can accommodate all of the components of the hearing aid, including the microphone and the battery, within the housing created by the shell that fits within the user's ear.

Using the test shell and method of fitting described herein, more robust, detailed, and helpful information can be gathered before making the shell of a custom ear-wearable device, leading to a much higher likelihood of a final shell having a proper fit without rework. A test shell including translucent or transparent material includes a body extending between an ear canal end and an aperture end. The aperture end defines a first aperture. The body defines a shell cavity extending away from the first aperture in the direction of the ear canal end.

In a method of fitting described herein, an ear impression is taken by the caregiver with an elastomeric material. The ear impression is then optically scanned and digitized to create an ear impression data file of the digital scan of the ear impression. The ear impression data file then goes through a modeling process to create a model data file.

During the modeling process, the shape of the ear impression is altered digitally in order to fit the type of custom ear-wearable device selected by the user. The model data file is then used to produce, such as by 3D printing or other production methods, an ear-wearable device test shell using translucent or transparent material. These steps of scanning, digitizing, modeling, and producing the test shell can be performed by a manufacturer at a location separate from the caregiver. It is also possible for these steps to be performed at the caregiver location.

The test shell is provided to the caregiver who checks to see if the test shell properly fits the user. In addition to asking the user about the comfort of the fit and whether an acoustic seal is present, as in traditional processes, the caregiver can examine the quality of the fit optically, such as by shining light through the test shell and observing the test shell in the user's ear cavity. The caregiver can examine the test shell within the user's ear cavity with an otoscope, record a digital image, or take a video recording, or perform a combination of these actions, to gather more information about goodness of fit of the test shell.

If the test shell is improperly fitted, the caregiver may decide to take a new ear impression. This need is realized earlier than in traditional manufacturing methods, because it occurs before the steps of installing the internal components of the ear-wearable device within the final shell cavity.

In some examples of the method of fitting, the user is asked to move in a variety of ways while the test shell is positioned in the user's ear cavity so that the user can assess the comfort of the fit and whether there is an acoustic seal under those movement conditions. The user can be asked to chew, swallow, yawn, walk, talk, bite, and perform other motions. The user can assess goodness of fit of the test shell while and after these motions are performed. The caregiver can record the user's observations of goodness of fit while these motions are performed.

In some examples, the test shell is made of a strong, durable material that has properties similar to the material of the final shell. The test shell can be made of the same material as the final shell. In either case, the user can use the test shell to more accurately assess the likely fit and comfort of the final shell. The more durable material also allows the user to take the test shell home, wear the test shell over a longer period of time, and wear the test shell during a range of activities.

The method and test shell described herein acknowledge the dynamic nature of the user's ear cavity, which will have a slightly different shape on different days and during different movements. The method gathers data over the course of these changes to improve the likelihood of a proper fit of the final shell.

In some examples, the body of the test shell includes a light-sensitive material, which can display, when exposed to light, a visual contrast to a human eye between test shell portions contacting the user's ear cavity and test shell portions not contacting the user's ear cavity when illuminated. As a result, the caregiver can more easily observe the fit of the test shell. Also, the areas of contact and areas of non-contact can be more easily observed on images taken with a camera or video camera. The light-sensitive material can be sensitive to visual light, ultraviolet light, or infrared light. An otoscope can be used to shine light in the light cavity while the caregiver observes the light-sensitive material and how it interacts with the user's ear cavity, and to record images.

In some examples, the test shell includes indicia of ear anatomy of the user on a surface of the shell. The indicia can be positioned on an outer surface of the test shell or on an inner surface of the test shell. The indicia locations on the test shell are intended to correspond to parts of the user's ear anatomy in contact with those locations of the test shell when the test shell is in the user's ear cavity. Examples of indicia include words, letters, numbers, or symbols. In one example, the indicia are names of one or more parts of the ear anatomy, such as aperture, second bend, bulbous area, acoustic seal, helix, tragus, antitragus, concha, and crus of helix. The indicia can help the caregiver to assess goodness of fit of the test shell.

In some examples, the test shell includes a pressure-sensitive color changing material that changes color in response to pressure and is present on an exterior surface of test shell. As a result, the caregiver can more easily observe the fit of the test shell and the areas of contact and non-contact. Also, the areas of contact, tight contact, loose contact, and non-contact can be more easily observed and distinguished from each other on images taken with a camera or video camera. Also, areas of higher pressure contact with the user's ear cavity can be observed on the test shell after the test shell is removed from the user's ear.

Custom Ear-Wearable Devices

Custom ear-wearable devices provide a number of advantages to the user. They can produce sound that seems more natural to the user because the hearing aid receiver, or speaker, is closer to the eardrum than non-custom ear-wearable devices. This proximity enables a higher-quality sound at a lower volume. Another contributor to quality is that the microphone can collect sound from in the ear itself, rather than from behind the ear. This takes advantage of the ear's pinna, the external part of the ear, to funnel sounds to the microphone. The microphone is also more shielded from wind. Custom ear-wearable devices are also easier to put on because they are formed as a single housing, rather than two parts, and the shell is customized to the user's anatomy.

One traditional process for forming a custom hearing aid will now be described. A caregiver, such as an audiologist or technician at an audiologist's office, takes an ear impression of the user's ear or ears with elastomeric material. Typically, an impression of each of the user's two ears is taken because users are typically fitted with an ear-wearable device for each ear, though there are circumstances where a single ear impression is taken. Where this description refers to "the ear impression," it is understood that there are usually two ear impressions made for each user, because one is made for each of the user's ears.

Each ear impression is a snapshot of the user's ear cavity at the specific time of the ear impression, typically while the user is holding still to facilitate the work of taking the ear impression. The ear impression is then typically sent to a manufacturer, where the ear impression is optically scanned and digitized to create an ear impression data file of the digital scan of the ear impression. The ear impression data file then goes through a modeling process to create a model data file.

During the modeling process, the shape of the ear impression is altered digitally in order to fit the type of custom ear-wearable device selected by the user. Examples of different types of custom ear-wearable devices include the following, which are mentioned from larger to smaller: in-the-ear (ITE) ear-wearable devices, in-the-canal (ITC) ear-wearable devices, completely-in-canal (CIC) ear-wearable devices, and invisible (IIC) ear-wearable devices. Each of these custom ear-wearable devices has a different size and mates with a differently sized portion of the user's ear cavity. The modeling process shapes the shell to serve one of these types of ear-wearable devices. The modeling process is performed by a human operator using a computer-aided design (CAD) program to produce the model data file. The modeling process is part art and part science. The modeling process is vulnerable to human error just like any human process.

The model data file is then used to produce, such as by 3D printing or other production methods, an ear-wearable device shell. The ear-wearable device shell then goes through a post-processing that includes small touch-ups to allow a shell cavity defined by the shell to receive the internal components of the particular, desired ear-wearable device. The steps of post-processing are also performed by a human operator and are also vulnerable to human error and can introduce error into the shell shape.

The shell is then used to manufacture the ear-wearable device, including steps such as securing internal components within the shell cavity, soldering internal components into electrical communication with each other, and closing off the shell cavity by securing a device face to an open side of the shell.

The finished ear-wearable device is then sent back to the caregiver and the caregiver checks to if the ear-wearable device properly fits the user. The fit is determined to be a proper fit or an improper fit. A proper fit is usually one in which the ear-wearable device forms an acoustic seal with the user's ear cavity, so that it is contacting the ear cavity around a circumference of the ear-wearable device at some location on the ear-wearable device. An improper fit is defined by either poor occlusion or user discomfort. Poor occlusion usually means that the ear-wearable device fits too loosely within the user's ear cavity. As a result, the ear-wearable device does not form the acoustic seal against the surfaces of the ear cavity. On the other hand, if the ear-wearable device fits too tightly in the user's ear cavity, the user is uncomfortable. The user often is not sure exactly which part of the ear-wearable device feels uncomfortable. As a result, it is often not clear how the ear-wearable device should be changed to lead to a comfortable fit.

An improper fit means rework or replacement of the shell. In some situations, rework can be performed at the caregiver's office to achieve a proper fit. On-site rework can include removing a bit of the outer surface of the shell to reduce tightness. A disadvantage of on-site rework is the extra time required of the caregiver.

More commonly, the ear-wearable device is sent back to the manufacturer location for production of a new shell. To attempt to make a shell with a proper fit, the manufacturer examines and revises the parameters used during the modeling, manufacturing, and post-processing steps and produces a new shell. The manufacturer often has very little guidance from the user or audiologist while performing this second attempt. If the results of the rework steps are not acceptable, in some situations, the ear impression is used to create a new shell using investment casting techniques, which results in the ear impression being destroyed. Rework steps, especially those taking place away from a caregiver location, delayed the user receiving the ear-wearable device.

Figure 2:
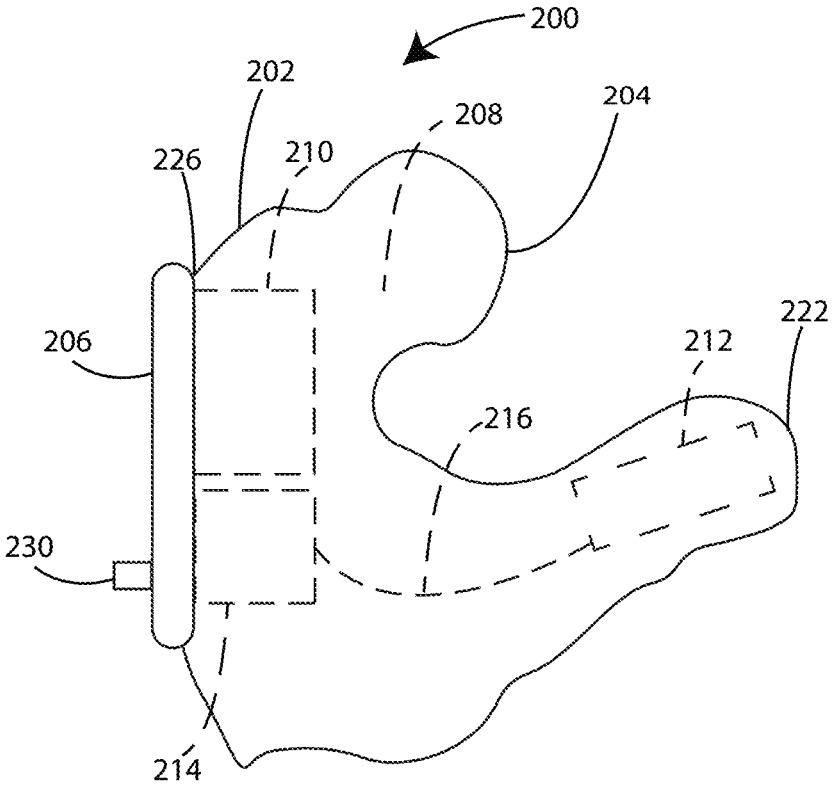
FIG. 2 is a schematic side view of an ear-wearable device in accordance with various embodiments herein.
Figure 3:
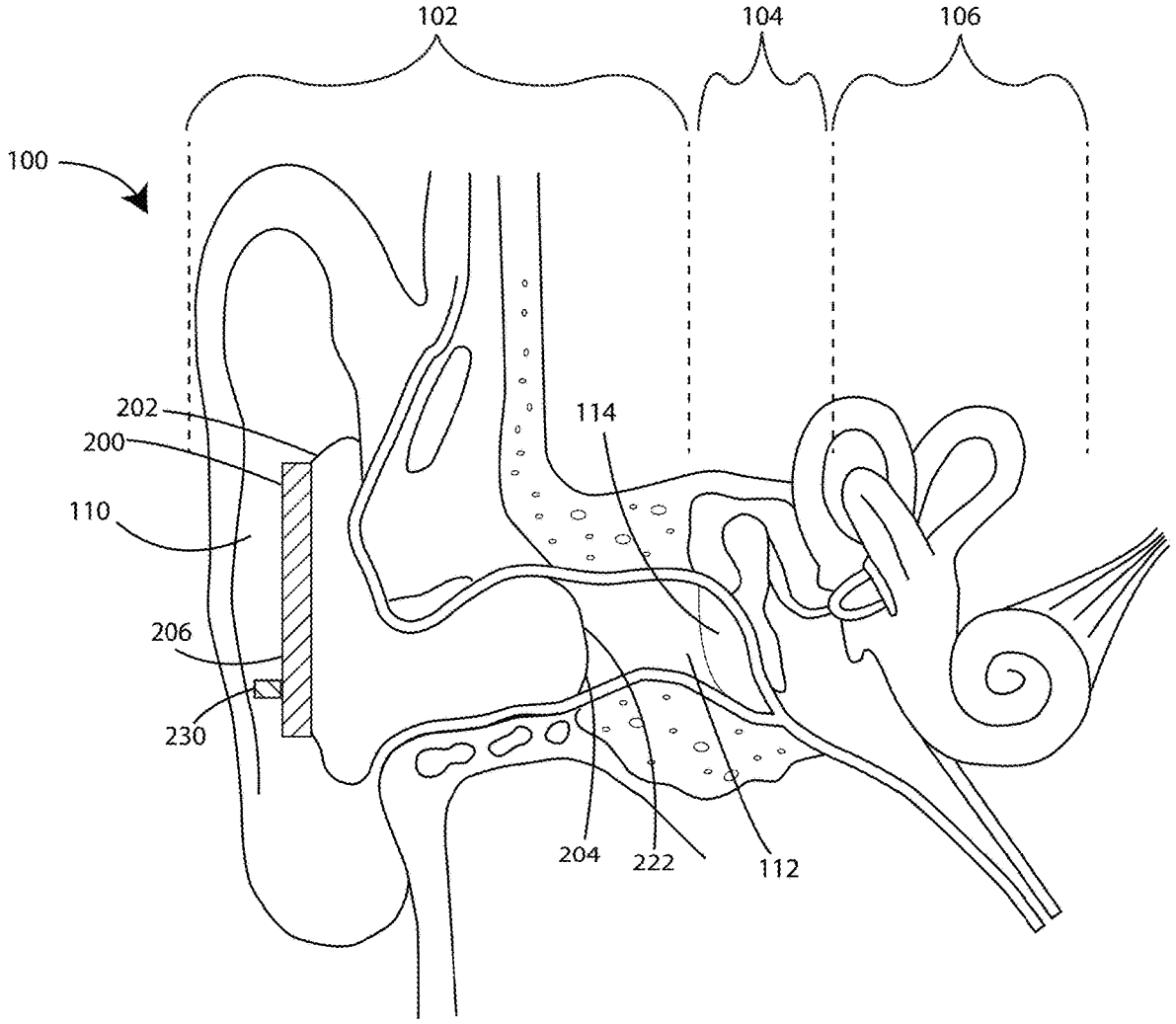
FIG. 3 is a schematic view of an ear-wearable device disposed within the ear of a user in accordance with various embodiments herein.

Ear Anatomy and Ear-Wearable Device (FIGS. 1-3)

The term "ear-wearable device" shall refer to devices worn on or in the ear. Ear-wearable devices can aid a person with hearing, such as a hearing assistance device or hearing aid. Examples of hearing assistance devices are devices that can aid a person with impaired hearing or that can produce optimized or processed sound for persons with normal hearing. Hearing assistance devices herein can include hearables (e.g., wearable earphones, headphones, earbuds, virtual reality headsets), hearing aids (e.g., hearing instruments), cochlear implants, and bone-conduction devices, for example. Hearing assistance devices that are also custom ear-wearable devices include, but are not limited to, in-the ear (ITE), in-the-canal (ITC), invisible-in-canal (IIC), or completely-in-the-canal (CIC) type hearing assistance devices, or some combination of the above. Ear-wearable devices can also be used to block sound or even be unrelated to hearing. In some embodiments herein, an ear-wearable device may also take the form of a piece of jewelry, or a component of frames of glasses, that may be attached to the head on or about the ear.

Referring now to FIG. 1, a partial cross-sectional view of ear anatomy 100 is shown. The three parts of the ear anatomy 100 are the outer ear 102, the middle ear 104 and the inner ear 106. The inner ear 106 includes the cochlea 108. The outer ear 102 includes the pinna 110, ear canal 112, and the tympanic membrane 114 (or eardrum). The middle ear 104 includes the tympanic cavity 115, auditory bones 116 (malleus, incus, stapes) and the semicircular canals 118. The inner ear 106 includes the cochlea 108, and the auditory nerve 120. The pharyngotympanic tube 122 is in fluid communication with the Eustachian tube and helps to control pressure within the middle ear generally making it equal with ambient air pressure.

Sound waves enter the ear canal 112 and make the tympanic membrane 114 vibrate. This action moves the tiny chain of auditory bones 116 (ossicles—malleus, incus, stapes) in the middle ear 104. The last bone in this chain contacts the membrane window of the cochlea 108 and makes the fluid in the cochlea 108 move. The fluid movement then triggers a response in the auditory nerve 120.

Many components of the outer ear 102 interact with one or more styles of custom ear-wearable device or a test shell for a custom ear-wearable device. The helix 126 is the outer rim of the ear that extends from the scalp to the earlobe 128. The concha 132 is the deepest depression of the pinna 110 and is located at the opening, or aperture 136, to the ear canal 112. The term ear cavity 140 will be used herein to describe the spaces defined by the concha 132 and the ear canal 112. The tragus (not shown in FIG. 1) is a small pointed eminence positioned in front of the concha 132 and the antitragus 144 is a prominence opposite the tragus.

The ear canal 112 itself has physical features that custom ear-wearable devices contact. The bulbous area 148 and the second bend 150 are physical features of the ear canal 112, and the shell 204 of the ear-wearable device 200 is ideally shaped to contact these features. The acoustic seal location 152, between the dashed lines in FIG. 1, is the portion of the ear anatomy where a circumferential seal will be formed with the ear-wearable device.

Ear-wearable devices can include an enclosure, such as a housing or shell, within which internal components are disposed. Components of ear-wearable devices described herein can include a control circuit, digital signal processor (DSP), memory (such as non-volatile memory), power management circuitry, a data communications bus, one or more communication devices (e.g., a radio, a near-field magnetic induction device), one or more antennas, one or more microphones, a receiver/speaker, and various sensors as described in greater detail below. More advanced ear-wearable devices can incorporate a long-range communication device, such as a Bluetooth® transceiver or other type of radio frequency (RF) transceiver.

Referring now to FIG. 2, a schematic view of an in-the-ear style custom ear-wearable device 200 is shown in accordance with various embodiments herein. The ear-wearable device 200 can include an ear-wearable device housing 202 formed by a shell 204 and a faceplate 206. The shell 204 is custom shaped to mate with the user's ear anatomy and defines an internal shell cavity 208 and a shell aperture at the entrance to the shell cavity 208. The faceplate 206 is attached to the shell at the shell aperture to enclose the shell cavity 208.

The ear-wearable device housing 202 can define a battery compartment 210 in which a battery can be disposed to provide power to the device. The ear-wearable device 200 can also include a receiver 212. The receiver 212 can include a component that converts electrical impulses into sound, such as an electroacoustic transducer, speaker, or loudspeaker. The housing 202 can also define a component compartment 214 that can contain electrical and other components including but not limited to a microphone, a processor, memory, various sensors, one or more communication devices, power management circuitry, and a control circuit. A cable 216 or connecting wire can include one or more electrical conductors and provide electrical communication between components inside of the component compartment 214 and components inside of the receiver 212.

The shell 204 extends from an ear canal end 222 to an aperture end 226. At the aperture end 226, the shell 204 defines an aperture that is closed by the faceplate 206. The faceplate 206 is sealed to the shell 204. The faceplate 206 is shown in FIG. 2 only in a side view but can include many features and structures. A user input device 230 is shown as part of the faceplate in FIG. 2, and can be a button, lever, switch, dial, or other input device. The faceplate 206 may also include a battery door, a microphone opening, a pull handle, and other features.

The ear-wearable device 200 shown in FIG. 2 is an in-the-ear style device and thus the shell is designed to be placed within the ear cavity. However, it will be appreciated that many different form factors for ear-wearable devices are contemplated herein. Aspects of ear-wearable devices and functions thereof are described in U.S. Pat. No. 9,848,273; U.S. Publ. Pat. Appl. No. 20180317837; and U.S. Publ. Pat. Appl. No. 20180343527, the content of all of which is herein incorporated by reference in their entirety.

FIG. 3 is a schematic view of an ear-wearable device 200 disposed within the ear of a user in accordance with various embodiments herein. The housing 202 of the ear-wearable device 200 is defined by the shell 204, which is positioned within the ear canal 112, and the faceplate 206, which is positioned in the concha. The user input device 230 on the faceplate 206 is accessible to be manipulated by the user without having to remove the ear-wearable device from their ear. The ear canal end 222 of the shell 204 is positioned close to the user's tympanic membrane. Ideally, the shell 204 fits properly within the user's ear cavity. A proper fit is usually one in which the ear-wearable device forms an acoustic seal with the user's ear cavity, so that it is contacting the ear cavity around a circumference of the ear-wearable device at some location on the shell 204 of the ear-wearable device 200. A proper fit is also comfortable to the user, so that the shell 204 is not putting too much pressure on the walls of the ear canal 112 or features of the concha. The receiver 212 (FIG. 2) is positioned within the shell 204 at the ear canal end 222 of the shell 204 to minimize the distance between the receiver 212 and the tympanic membrane 114 without physically contacting the tympanic membrane 114.

Test Shell

FIGS. 4-7 are gray-scale images of a test shell 404 for assessing fit in an ear of a user of an ear-wearable device from various viewing angles in accordance with various embodiments herein. FIG. 8 is a schematic, cross-sectional view of a test shell in accordance with various embodiments herein. The test shell 404 can, in some embodiments, have the same shape, same features, use the same materials, and appear very similar to a final shell that emerges from the manufacturing process of an ear-wearable device. Other than the indications of ear anatomy being present only on the test shell 404, the descriptions of the test shell 404 can apply to embodiments of a final shell.

The test shell 404 is made of a body 406 having an ear canal end 422 and an aperture end 426 and the body 406 extends between these two ends. The extension between the ear canal end 422 and the aperture end 426 is not a uniform, smooth body, but rather has curves, bumps and turns that are created during the molding process to follow and be in contact with the ear anatomy of the user.

The body 406 is sized to fit within an ear of a user of an ear-wearable device, so that a goodness of fit of the test shell 404 in the user's ear can be assessed. The body 406 can be roughly divided between an ear canal portion 428 and a concha portion 430, where the ear canal portion 428 is sized and configured to fit within the ear canal of the user. The concha portion 430 is sized and configured to fit within a concha of a user.

Figure 4:
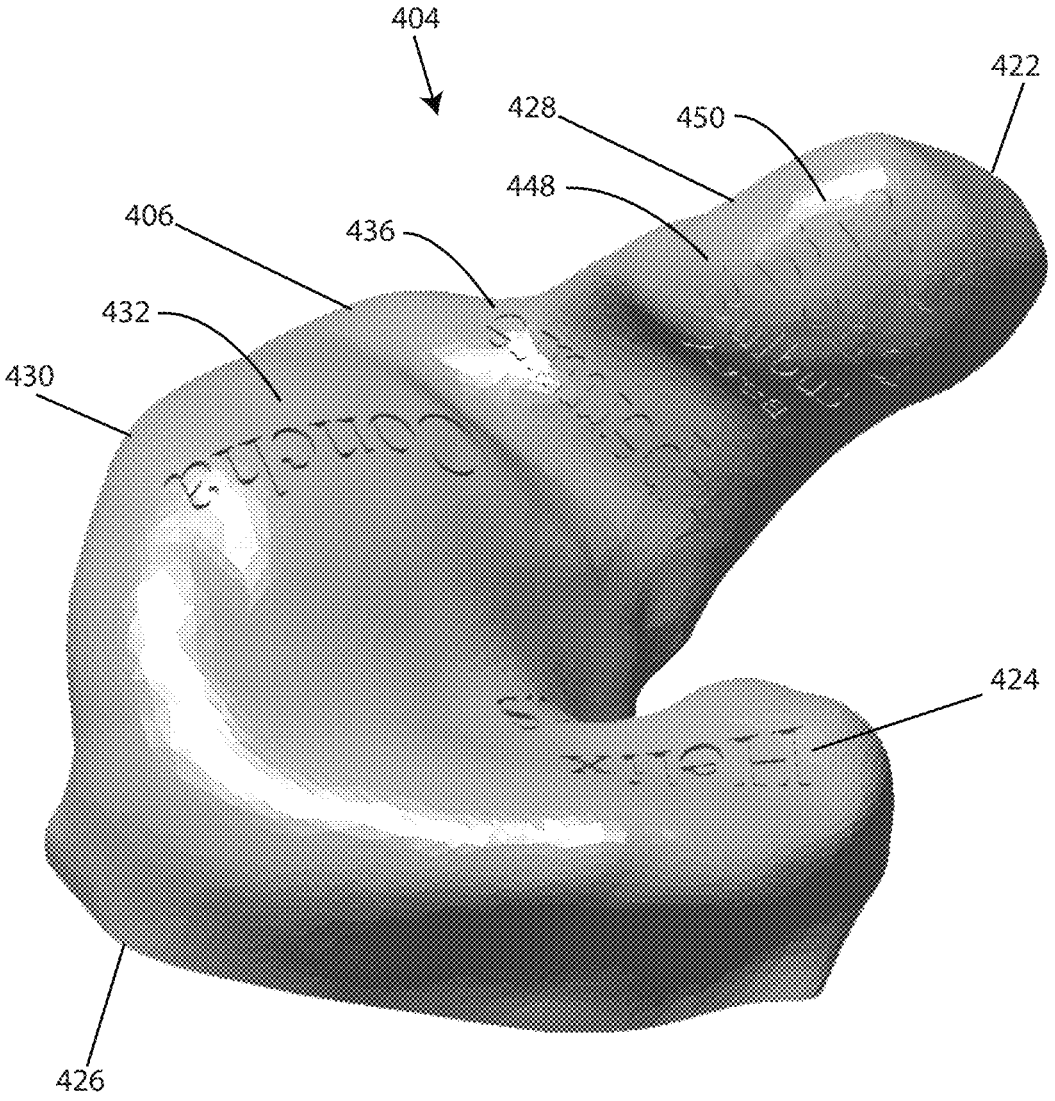
FIG. 4 is a side view, gray-scale image of a test shell in accordance with various embodiments herein.
Figure 5:
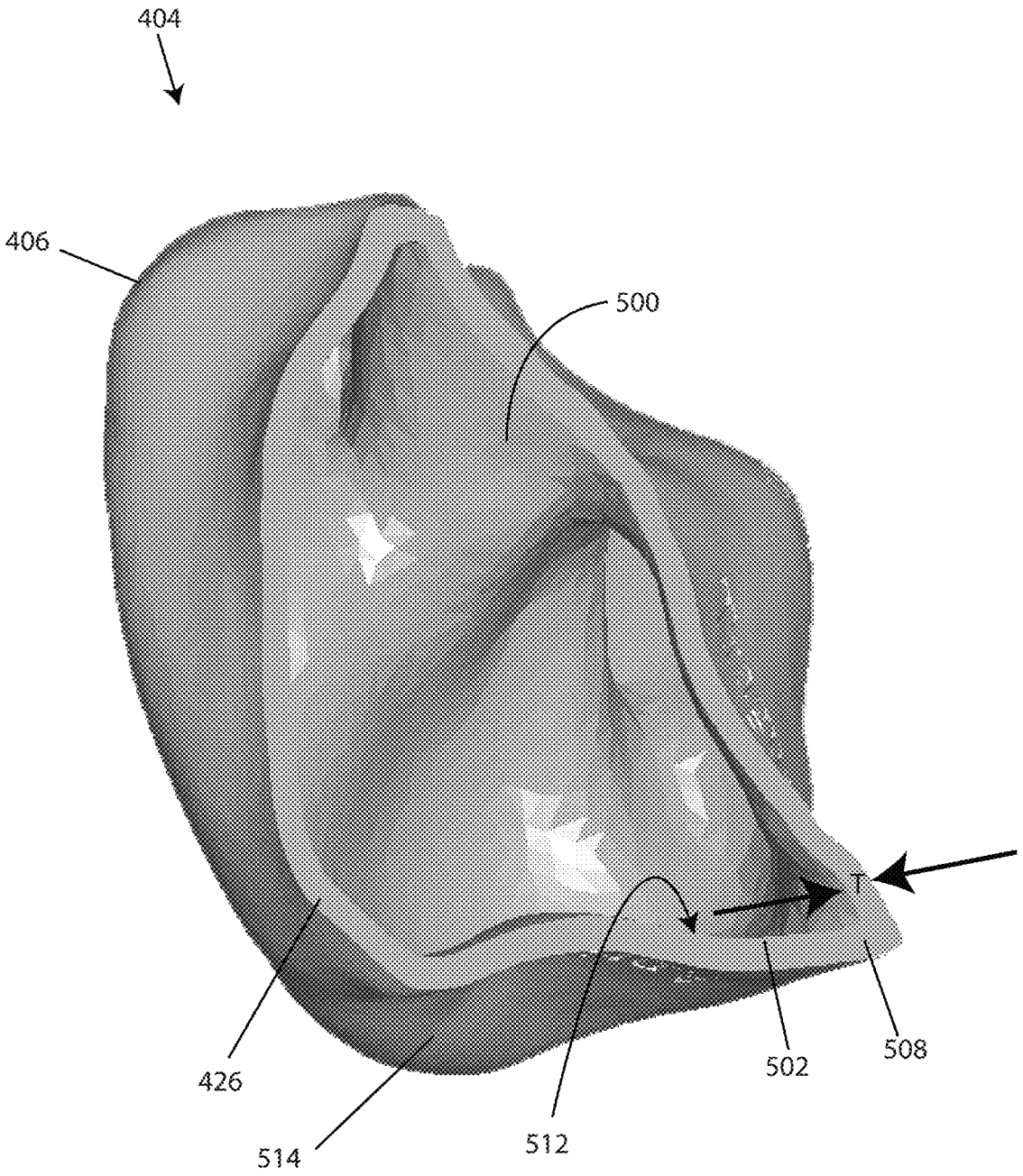
FIG. 5 is a bottom view, gray-scale image of the test shell of FIG. 4 in accordance with various embodiments herein.
Figure 7:
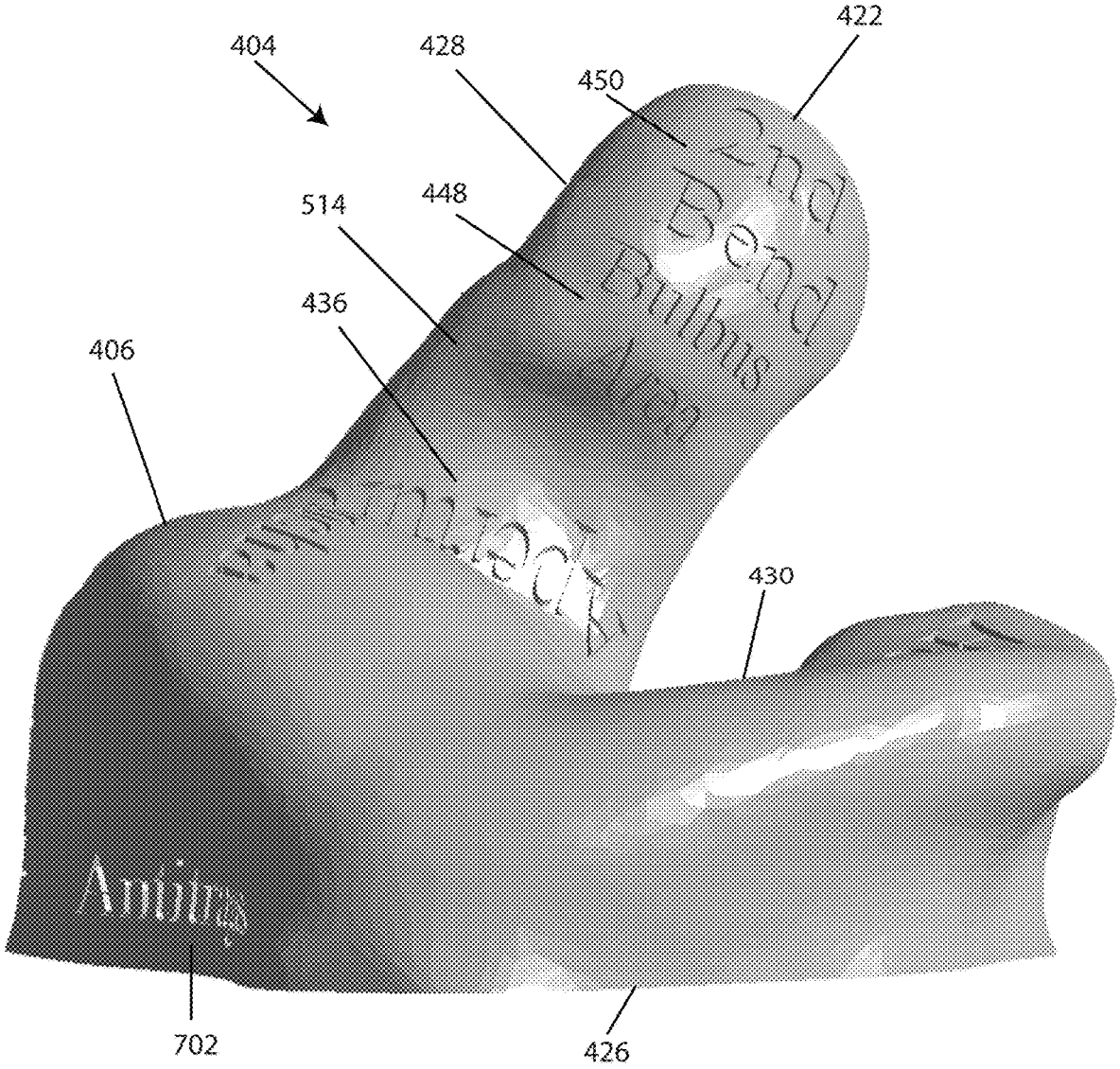
FIG. 7 is yet another side view, gray-scale image of the test shell of FIG. 4 in accordance with various embodiments herein.
Figure 8:
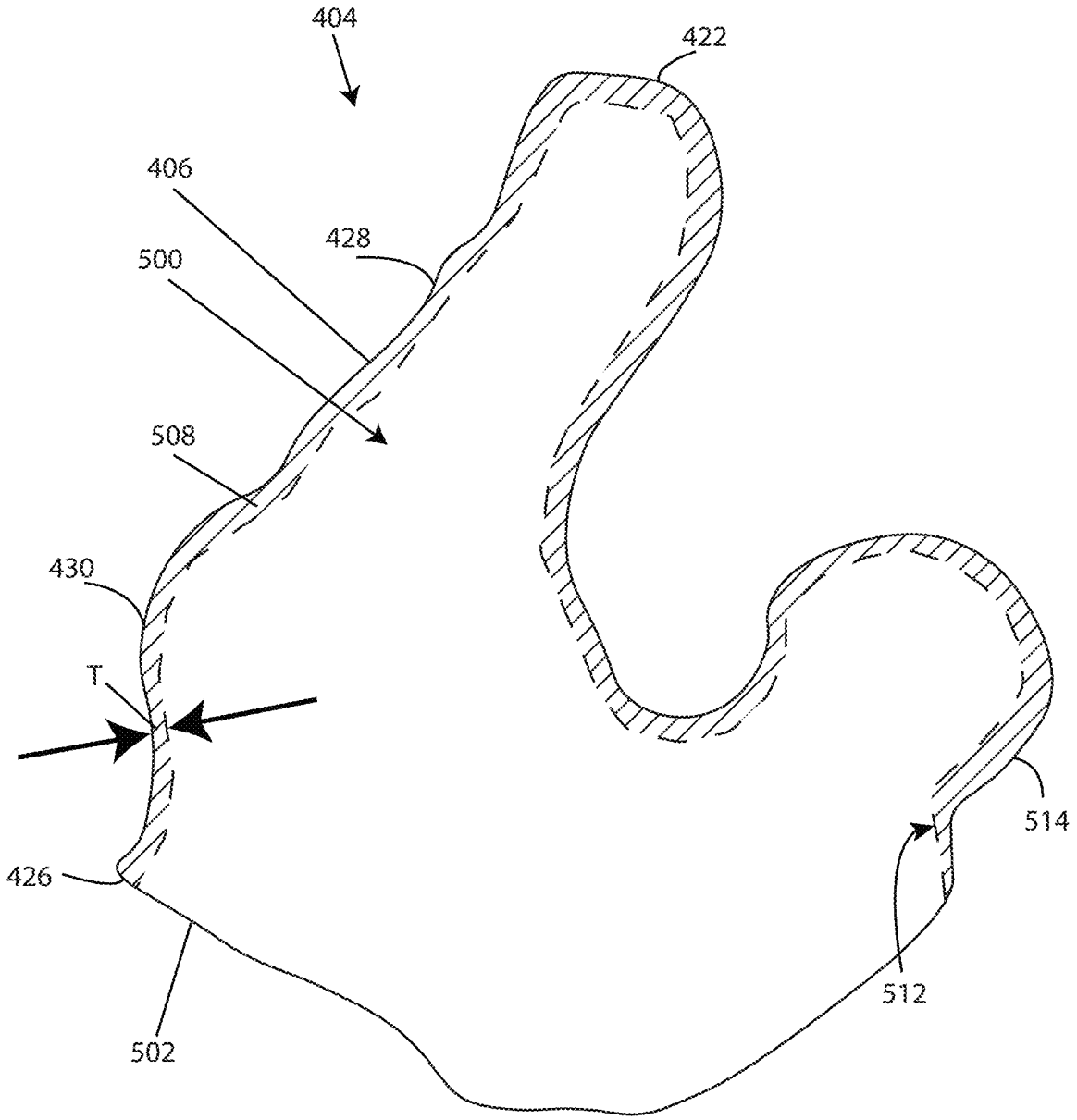
FIG. 8 is a schematic, cross-sectional view of a test shell in accordance with various embodiments herein.

Now referring to FIG. 4, the bottom view of FIG. 5, and the cross-sectional view of FIG. 7, the body 406 defines and partially encloses a shell cavity 500 that extends away from the aperture end 426. A first shell aperture 502, also referred to as a first aperture 502 herein, is defined by the aperture end 426. The shell cavity 500 extends toward the ear canal end 422 of the test shell 404. The body 406 has a body wall 508 having a thickness T. The body wall 508 defines an interior surface 512 and an exterior surface 514. The body wall 508 has fairly consistent thickness T, so that the interior surface 512 and the exterior surface 514 have generally the same shape but spaced away from each other by the thickness T of the wall.

In some embodiments, the thickness T can be greater than or equal to 0.4 millimeters (mm), 0.5 mm, 0.6 mm, or 0.7 mm. In some embodiments, the thickness T can be less than or equal to 1.0 mm, 0.9 mm, 0.8 mm, or 0.7 mm. In some embodiments, the thickness T can fall within a range of 0.4 mm to 1.0 mm, or 0.5 mm to 0.9 mm, or 0.6 mm to 0.8 mm, or can be about 0.7 mm.

The test shell first aperture 502 has a maximum dimension spanning across the first aperture 502. In some embodiments, the first aperture maximum dimension can be greater than or equal to 12 mm, 17 mm, 21 mm, or 26 mm. In some embodiments, the first aperture maximum dimension can be less than or equal to 40 mm, 35 mm, 31 mm, or 26 mm. In some embodiments, the first aperture maximum dimension can fall within a range of 12 mm to 40 mm, or 17 mm to 35 mm, or 21 mm to 31 mm, or can be about 26 mm.

The test shell 404 has an end-to-end length extending from the ear canal end 222 to the aperture end 226. In some embodiments, the test shell end-to-end length can be greater than or equal to 12 mm, 17 mm, 21 mm, or 26 mm. In some embodiments, the test shell end-to-end length can be less than or equal to 44 mm, 38 mm, 32 mm, or 26 mm. In some embodiments, the test shell end-to-end length can fall within a range of 12 mm to 44 mm, or 17 mm to 38 mm, or 21 mm to 32 mm, or can be about 26 mm.

Figure 9:
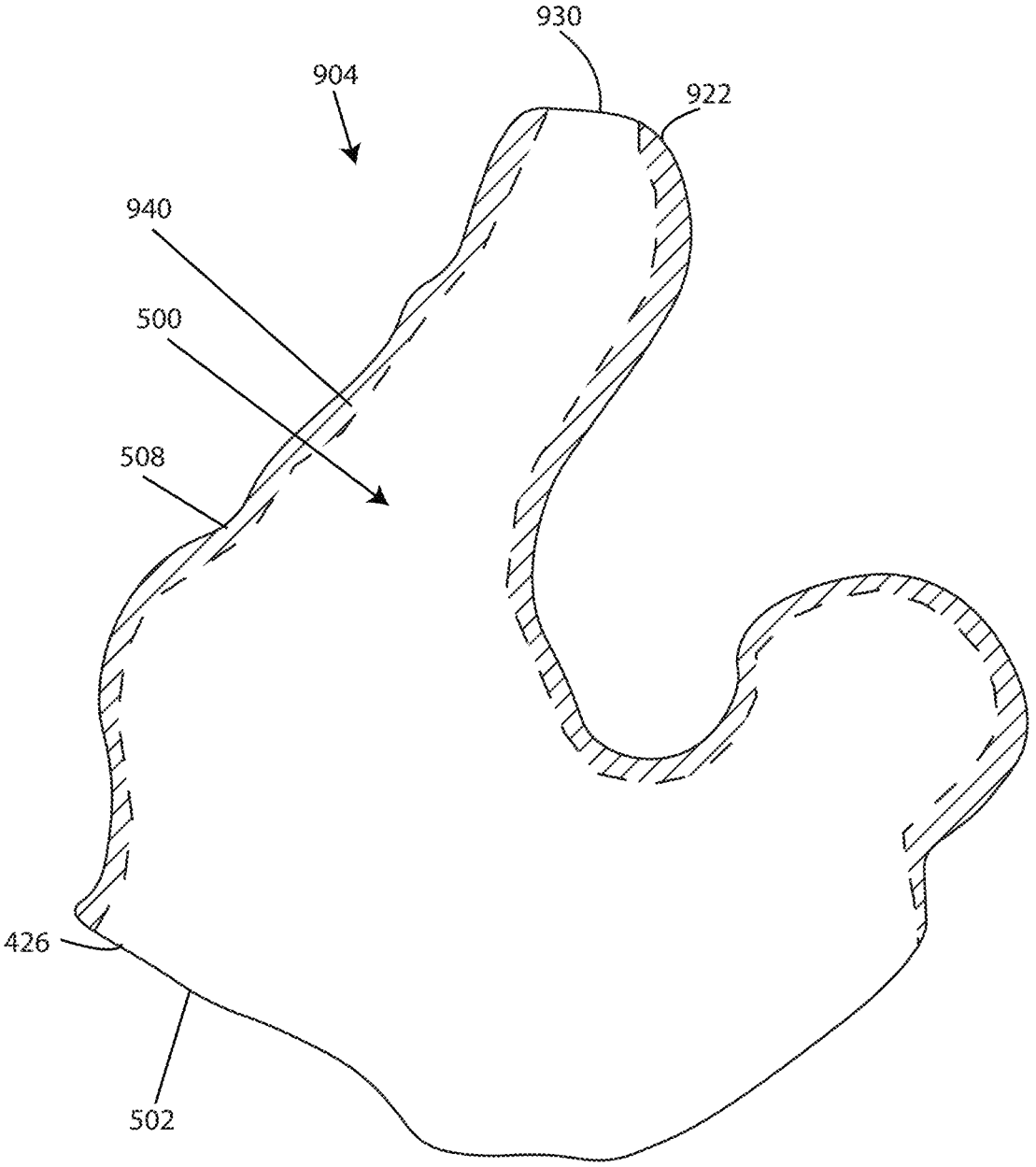
FIG. 9 is a schematic, cross-sectional view of an alternative test shell in accordance with various embodiments herein.

As seen in FIGS. 4-7, in some embodiments, the test shell 404 has an ear canal end 422 that does not define an aperture. For this embodiment, the ear canal end 422 is a closed end of the test shell body 406. In an alternate embodiment shown in a schematic, cross-sectional view in FIG. 9, a test shell 904 has an ear canal end 922 that defines a second aperture 930. As a result, the ear canal end 922 is an open end. The test shell 904 can be otherwise like the test shell 404 described herein. For example, the test shell 904 has a body 940 including a body wall 508 and an aperture end 426 and defining a first aperture 502. The test shell 904 partially encloses a test shell cavity 500 that extends from the first aperture 502 to the second aperture 930. The second aperture 930 can provide an advantage during the molding process by making it easier to remove the test shell 904 from a mold. The test shell 904 is not intended to contact the user's anatomy at the location of the second aperture 930, because it is intended that the final shell will have an ear canal end that is spaced away from the user's tympanic membrane. As a result, there is no need to observe goodness of fit at the location of the second aperture 930 and no data lost regarding goodness of fit by the inclusion of the second aperture 930.

In some embodiments, the test shell body 406 is made of a transparent or translucent material to allow inspection of the fit in the user's ear by a caregiver before a final shell is manufactured. The body 406 can be optically clear or include optically clear material, in some embodiments. The body 406 can be made of acrylic, ultraviolet (UV) curable acrylic, UV-curable acrylate, polyurethane, or glass, for example. One example of a suitable UV-curable acrylate material is FotoTec® SL.A material obtainable from Dreve Otoplastik GmbH, having a location in Unna, Germany. Another example of a UV-curable acrylate is Pro3Dure GR1 material, available from Pro3dure Medical GmbH, having a location in Iserlohn, Germany.

The material used for the test shell can be the same material used to form a final shell for an ear-wearable device.

The body can be made of a material having a material having a light transmission percentage of about 85% or more as tested using ASTM D-1003. In some embodiments, the light transmission percentage as tested using ASTM D-1003 can be greater than or equal to 80%, 82%, 84%, 86%, 88%, 90%, 92%, 94%, or 95%, or can be an amount falling within a range between any of the foregoing.

Because the test shell body 406 is translucent or transparent in these embodiments, a caregiver is able to peer through the test shell wall to optically examine the goodness of fit of the test shell 404 while the test shell is positioned in the user's ear. The caregiver checks to see if the test shell properly fits the user. The caregiver can look for visual evidence that an acoustic seal is present, as well as asking the user about the fit quality. The caregiver can shine light through the test shell and observe the test shell in the user's ear cavity, such as by using an otoscope. While the test shell is within the user's ear, the caregiver can also record a digital image of the test shell, take a video recording, or perform a combination of these actions, to gather more information about goodness of fit of the test shell.

The user's ear cavity is not a static space that is always in the same shape. In contrast, the user's ear cavity changes shape as the user moves and performs certain actions. To check the goodness of fit across a range of possible ear cavity, the user can be asked to move, such as clench their jaw, talk, swallow, yawn, or smile during the visual examination, so that the caregiver can examine the goodness of fit in a range of possible configurations of the ear canal.

Because the ear cavity has a dynamic nature, it can be valuable for the user to wear the test shell away from the caregiver's office. For example, the user can take the test shell home and wear it over the course of a few days to evaluate goodness of fit. Some traditional test shells are made of fragile material and would not hold up and maintain their integrity and shape over the course of a longer period of time and multiple insertions and extractions. In some embodiments, the material of the test shell is durable and long lasting. In some embodiments, the material has a tensile strength of at least about 55 megapascals. In some embodiments, the tensile strength can be greater than or equal to 50 megapascals, 52 megapascals, or 55 megapascals. In some embodiments, the tensile strength can be greater than or equal to 58 megapascals, 60 megapascals, or 62 megapascals. In some embodiments, the tensile strength can be less than or equal to 60 megapascals, 58 megapascals, or 55 megapascals. In some embodiments, the tensile strength can fall within a range of 50 megapascals to 60 megapascals, or 52 megapascals to 58 megapascals, or can be about 55 megapascals.

Tensile strength can be tested using ASTM D638, Standard Test Method for Tensile Properties.

Light-Sensitive Material

A light-sensitive material can be used to form the test shell in order to increase the caregiver's ability to distinguish between areas of anatomical contact with the test shell and areas of anatomical non-contact. The light-sensitive material can be present only as an exterior surface of the test shell, such as with a coating, or can form the entire wall of the test shell. In these embodiments, the light-sensitive material displays, when exposed to light, a greater visual contrast to a human eye between test shell portions contacting the user's ear and test shell portions not contacting the user's ear when illuminated than when not illuminated, such as with ultraviolet light, infrared light, or visible light. Examples of light-sensitive material include autofluorescence material.

Indicia of Ear Anatomy on Test Shell

Figure 6:
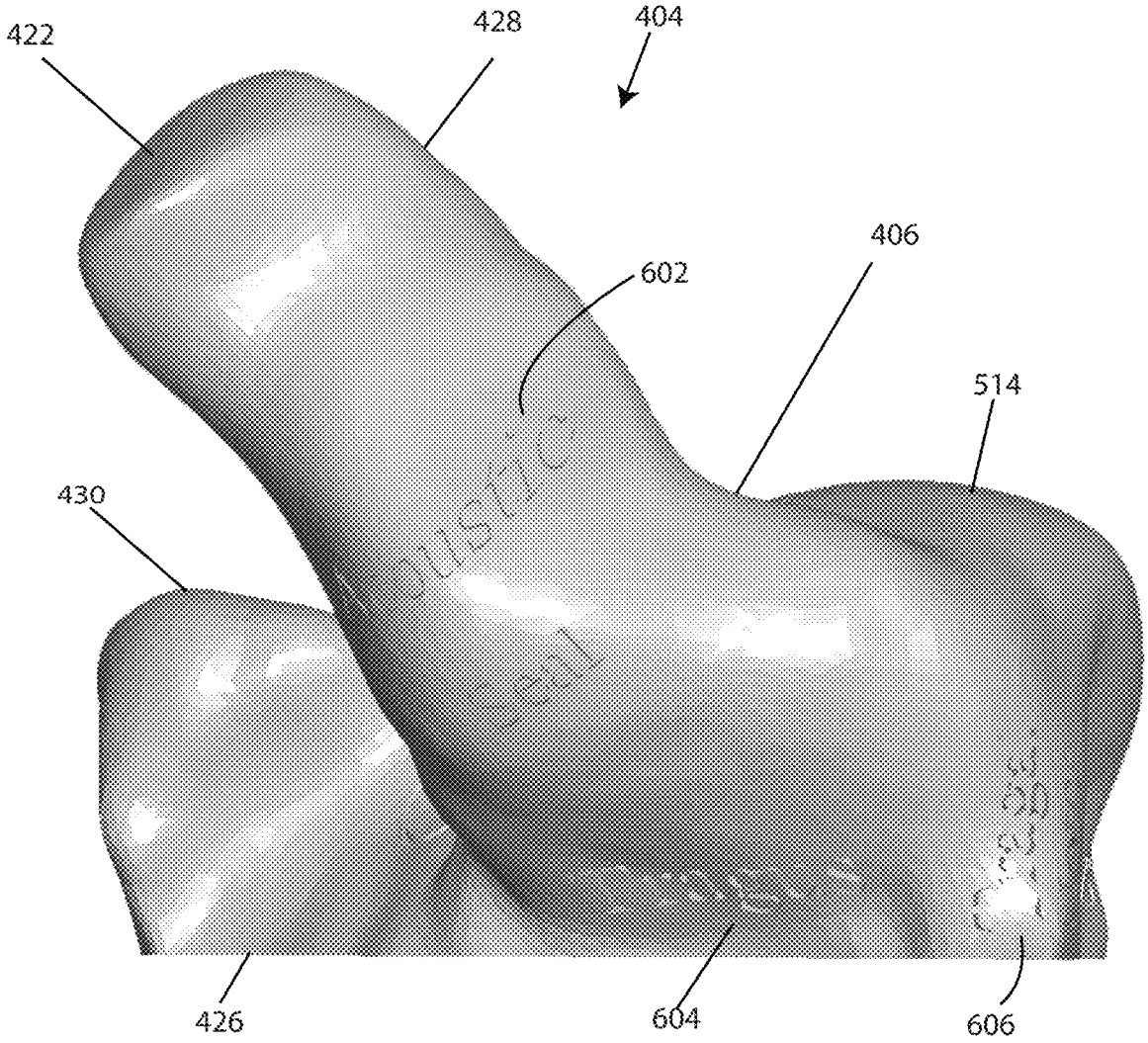
FIG. 6 is another side view, gray-scale image of the test shell of FIG. 4 in accordance with various embodiments herein.

Now referring to FIGS. 4 and 6-7 showing gray scale images views from different angles, indicia of ear anatomy of the user on the test shell will now be described. As a caregiver looks through the transparent or translucent material of the test shell to examine goodness of fit, it can be helpful for the test shell to have indicia positioned on an exterior surface 514 of the test shell or on an interior surface 512 of the test shell. The indicia locations on the test shell are intended to correspond to parts of the user's ear anatomy in contact with those locations of the test shell when the test shell is in the user's ear cavity. Examples of indicia include words, letters, numbers, or symbols.

The embodiment of FIGS. 4 and 6-7 include indicia or indications in the form of English words on the exterior surface 514 of the test shell. In one example, the indicia are names of one or more parts of the ear anatomy. In FIG. 4, the following indicia are visible: helix indicia 424, concha indicia 432, aperture indicia 436, bulbous area indicia 448, and second bend indicia 450. The view of FIG. 6 shows the following indicia on the test shell exterior surface 514: acoustic seal indicia 602, tragus indicia 604, and tragal notch indicia 606. FIG. 7 illustrates that the test shell 404 includes aperture indicia 436 and bulbous area indicia 448 on the ear canal portion 428. The test shell 404 also has second bend indicia 450 near the ear canal end 422 and antitragus indicia 702 on the concha portion 430 of the test shell near the aperture end 426.

The indications on the test shell are optional. In some situations, the indications are helpful for identifying ear canal anatomy and providing precise terminology for communication of detailed information about the fit within the ear canal. Compared to a very experienced caregiver, a less experienced caregiver may have a more difficult time identifying ear anatomy or communicating information about the fit efficiently and with enough detail. Also, the indications could assist with language differences between the caregiver and the manufacturing personnel.

Figure 10:
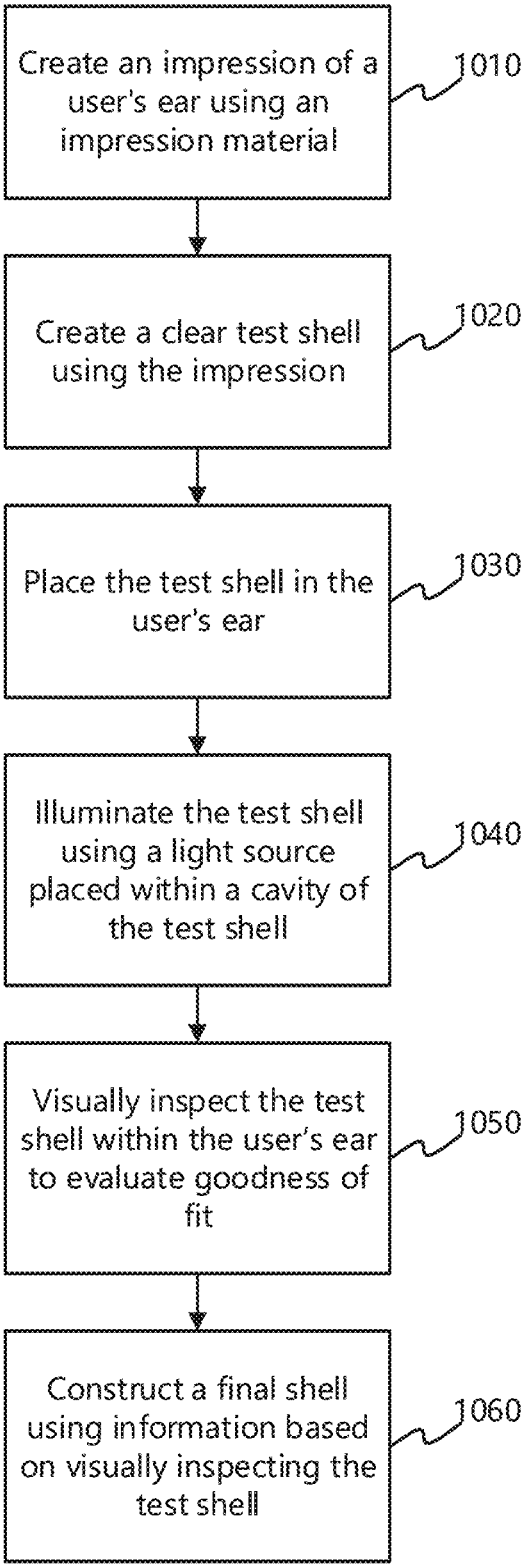
FIG. 10 is a flowchart of a method of fitting a user with an ear-wearable device in accordance with various embodiments herein.
Figure 11:
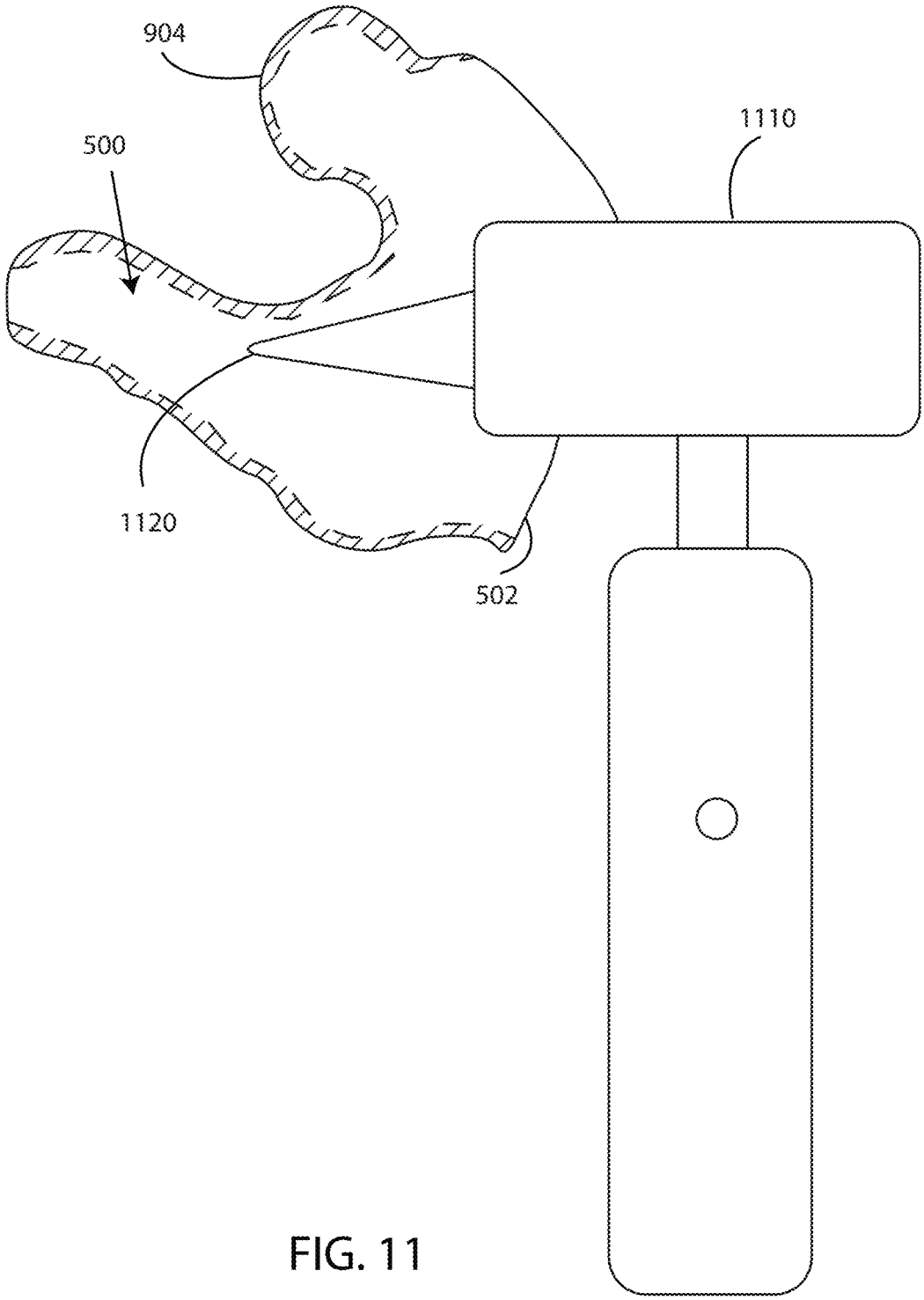
FIG. 11 is a schematic, partial cross-sectional view of a test shell and an otoscope in accordance with various embodiments herein.

Method of Fitting (FIGS. 10-11)

Many different methods are contemplated herein, including, but not limited to, methods of making an ear-wearable device, method of making a final shell of an ear-wearable device, methods of assessing the fit of a test shell, methods of using a test shell, and the like. Aspects of the operation of the system for forming a test shell and for assessing fit for a test shell described elsewhere herein can be performed as operations of one or more methods in accordance with various embodiments herein.

Now referring to the flowchart of FIG. 10, in an embodiment, a method of fitting a user with an ear-wearable device will be described. The method includes creating an impression of the user's ear using an impression material 1010. The impression is a three-dimensional model of the spaces of user's ear cavity. This step is typically performed by a caregiver in a caregiver's office. Commercially available impression materials are used to create the impression. The impression material may be a liquid, powder, foam, or gel, such as a silicone gel. The impression material may be elastomeric. An otoblock, such as a small piece of foam or cotton, is placed in the ear canal so that the impression material has a block to adhere to and will not contact the tympanic membrane. Typically, a syringe or injector is then used to place and gently push ear impression material into the ear canal, gently pulling out as the canal begins to fill with the impression material. The caregiver continues to supply ear impression material to the ear canal, and after it is filled, to the spaces of the concha and other parts of the outer ear. The caregiver may ask the patient to move their jaw or make other facial movements. Some time may be required for the impression material to set. Once set, the impression is removed from the ear, twisting and pulling so that the impression follows the contours of the ear canal on its way out. In many embodiments, the impression extends at least 2 millimeters past the second bend of the user's ear cavity.

The otoblock can be trimmed off of the ear impression. Additional portions of the ear impression from the outermost parts of the ear can be trimmed off, in some situations. The ear impression may be cut down to an appropriate size for the model of ear-wearable device that has been specified for the patient. The ear impression can also be tapered and finely trimmed and shaped to improve the easy of insertion of the resulting shell or to mate with the shape of the intended model of ear-wearable device. These trimming steps are optional and may not be desired in some embodiments.

The method also includes creating a test shell using the impression 1020. Typically, the ear impression is sent to a manufacturer location for the test shell to be made using the impression. The ear impression, or the trimmed ear impression, if applicable, is then optically scanned to create an ear impression data file and corresponding image of the ear impression. The ear impression data file is then modified during a hearing aid modeling process to fit the type of custom ear-wearable device that has been specified for the user. The output of the modeling process is a model data file. Using the model data file, a test shell is then three-dimensionally printed, or formed in some other manufacturing process. Then the test shell is provided to the caregiver. Typically, this happens by shipping the test shell from a manufacturer location to a caregiver location.

FIGS. 4-7 show gray scale images of examples of test shells according to some embodiments. The test shell includes a body having an aperture end and an ear canal end, where the aperture end defines a first aperture. The body also defines a shell cavity extending away from the first aperture in a direction of the ear canal end. The body of the test shell is clear according to some embodiments. The body of the test shell includes a transparent or translucent material, according to some embodiments. The body is sized to fit within an ear of the user of an ear-wearable device.

The method includes placing the test shell into the user's ear 1030. Typically, this step happens at the caregiver's office. The method further includes illuminating the test shell, while the test shell is in the user's ear, using a light source placed within the shell cavity 1040. The method further includes visually inspecting the test shell, while the test shell is in the user's ear, using a light source to evaluate goodness of fit of the test shell in the user's ear 1050.

FIG. 11 illustrates an otoscope 1110, which includes a light source, positioned so that a tip 1120 of the otoscope 1110 is positioned within a shell cavity 500 of a test shell 904. The tip 1120 is inserted into first shell aperture 502 and the otoscope 1110 illuminates the test shell 904 while the caregiver visually inspects the test shell within the user's ear. The caregiver uses the visual inspection process to evaluate the goodness of fit of the test shell. In some embodiments, the caregiver records observations of goodness of fit parameters and specific locations where the test shell provides a good fit or a poor fit. The presence of indicia on the test shell can facilitate recording of this information and increase the specificity and detail in the caregiver's observations.

In some embodiments, the method includes capturing an image of the shell cavity of the test shell when the test shell is in the user's ear. In some embodiments, the caregiver records photographs or videos of the shell cavity of the test shell within the user's ear. In some embodiments, the otoscope 1110 includes or is connected to one or more of a camera, a digital camera, a video camera, and a digital video camera. In some embodiments, the otoscope 1110 includes a magnifying lens, a wide-angle lens or a fish-eye lens.

The patient may also be asked to make observations about the goodness of fit, such as whether they perceive that an acoustic seal is formed by the test shell and whether they feel that the test shell is comfortable, uncomfortable, tight, loose, tight at a specific location, or loose at a specific location. It can be difficult for the patient to know what specific location in the ear cavity is the source of discomfort, but sometimes the user has these types of perceptions.

In some embodiments, the method further includes recording a first user observation at a first time regarding goodness of fit during moving by the user. The user observations can include the user's feelings regarding the fit of the test shell, including feelings of comfort, feelings of discomfort, locations of discomfort, occlusion, lack of occlusion, or locations of lack of occlusion. When the final shell is created for an ear-wearable device, the first user observation can be used as input to the manufacturing process, along with using information recorded based on the caregiver visually inspecting the test shell.

The observations of the test shell made by the caregiver and patient are used to construct a final shell, including the information based on visual inspection of the test shell 1060. These observations may indicate that a second test shell should be formed before a final shell is formed.

In an embodiment, the method can further include moving by the user, while the test shell is in the user's ear. Examples of movement include biting, chewing, talking, walking, swallowing or yawning by the user. The caregiver visually inspects the shell cavity during these movements, while the test shell is in the user's ear.

The caregiver can record a first user observation regarding goodness of fit during moving by the user. Examples of the content of the first user observation include an observation regarding comfort, discomfort, locations of discomfort, occlusion, lack of occlusion, or locations of lack of occlusion. In an embodiment, the method can further include video recording of the shell cavity of the test shell, while the test shell is in the user's ear, during moving by the user.

Figure 12:
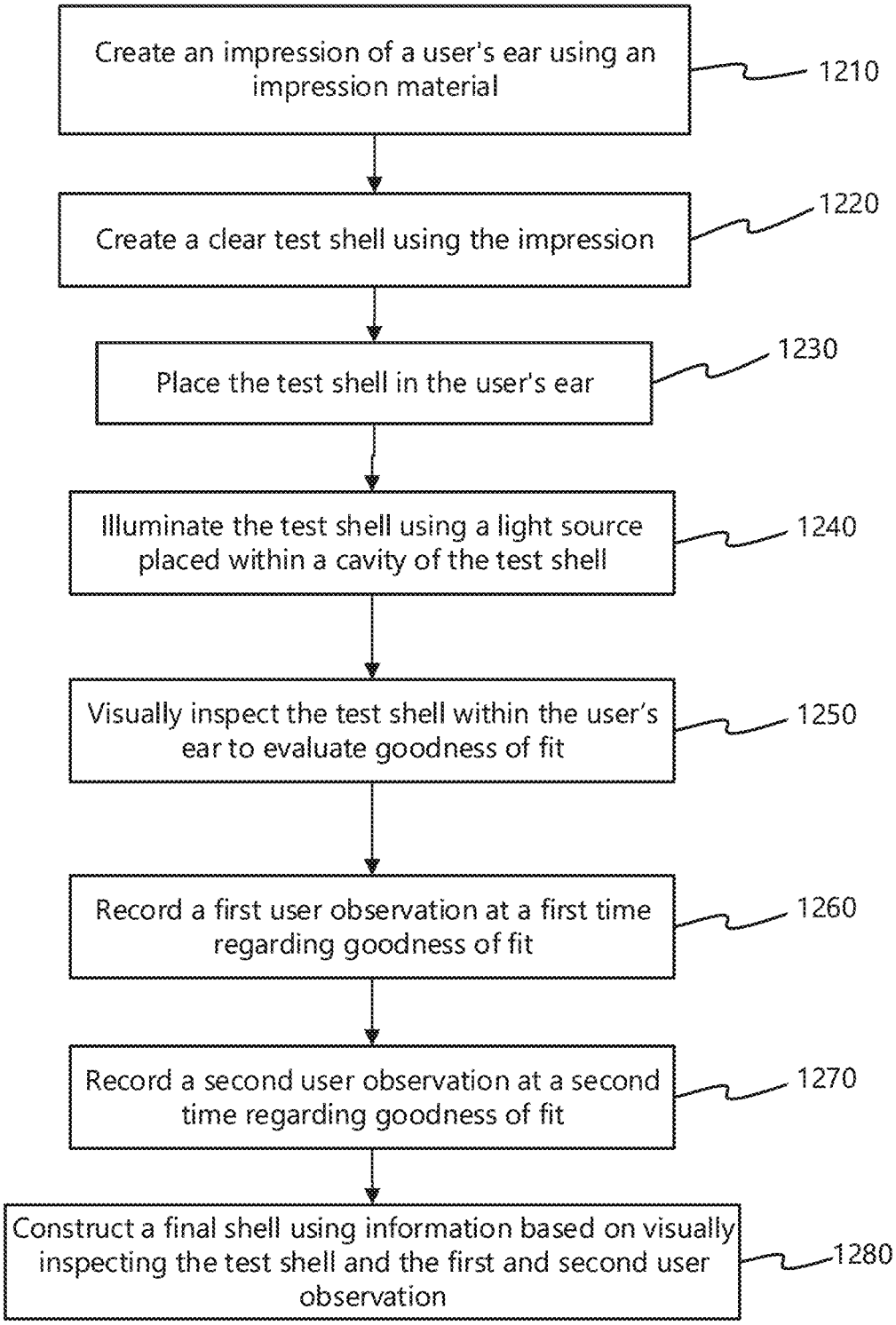
FIG. 12 is a flowchart of another method of fitting a user with an ear-wearable device in accordance with various embodiments herein.

Method of Fitting Using User Observations Later in Time (FIG. 12)

In one embodiment of the method of fitting, a robust and sufficiently durable test shell is created so that the user has the opportunity to take the test shell home from the caregiver's office and wear it over a longer period of time that a visit to the caregiver's office. A sufficiently durable test shell provides the opportunity for user observations at multiple points in time, to provide more details user feedback regarding the goodness of fit of the test shell.

FIG. 12 illustrates an embodiment of a method of fitting a user with an ear-wearable device where first user observations and second, later-in-time user observations are gathered. Many of the steps of FIG. 12 are identical to or similar to the steps described above with reference to FIG. 10, and the description related to FIG. 10 applies equally to the steps of FIG. 12. The method includes creating an impression of the user's ear using an impression material 1210 and creating a test shell using the impression 1220, where the test shell can be a clear test shell. The method includes placing the test shell in the user's ear 1230, illuminating the test shell using a light source placed within a cavity of the test shell 1240, and visually inspecting the test shell within the user's ear to evaluate goodness of fit 1250.

In some embodiments, the method further includes recording a first user observation at a first time regarding goodness of fit during moving by the user 1260. The user can take the test shell home and wear the test shell at a second, later time. In an embodiment, the method can further include recording a second user observation at the second time, regarding goodness of fit 1270. In one embodiment, the second time is at least one day later than the first time.

The method includes creating a test shell using the first user observation, the second user observation, and information recorded based on visually inspecting the test shell 1280. These observations and information can be used as input to the manufacturing process, thereby improving the likelihood that the final shell will provide a proper fit to the user.

In some examples, the method further includes making the first user observation, the second user observation, or both during moving by the user.

In an embodiment of the method, both the test shell and the final shell are made of material having a tensile strength of at least about 55 megapascals. The observations about the fit and feeling of the test shell will be especially relevant to the formation of the final shell if the same materials are used for both.

Figure 14:
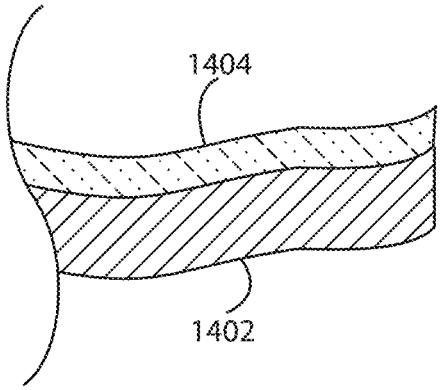
FIG. 14 is a schematic, cross-sectional view of a portion of a test shell having a pressure-sensitive coating in accordance with various embodiments herein.

Test Shell and Method Using Color-Changing Material (FIG. 14)

In some examples, the test shell includes a color-changing material that changes color in response to pressure or temperature and is present on an exterior surface of test shell. The color-changing material can be provided as a layer forming an exterior surface of a test shell or can be incorporated into the test shell material throughout the body wall.

FIG. 14 shows a cross-sectional view of a portion of a test shell wall 1402 having a color-changing material outer layer 1404. The structure of a test shell having a color-changing layer can be identical to any of the other embodiments of test shells described herein. For example, the test shell includes a body, includes an aperture end and an ear canal end. The aperture end defines a first aperture. The body includes a transparent or translucent material in some embodiments.

Some of the color-changing material on the test shell may experience a change in color due to undergoing pressure from the ear canal or temperature changes while in the ear canal. As a result of the color-changing material, the caregiver can more easily observe the fit of the test shell and the areas of contact and non-contact. Also, the areas of contact, tight contact, loose contact, and non-contact can be more easily observed and distinguished from each other on images taken with a camera or video camera. Areas of the test shell that had tighter contact with the user's ear cavity can be observed on the test shell after the test shell is removed from the user's ear by observing which areas of the test shell exterior surface have changed color during the time in the user's ear.

Examples of pressure indicating film include Fujifilm Prescale® Tactile Surface Pressure Indicating Film and Pressure-x® Low Pressure Application Film, and Mold-Align® Film. An example of a temperature-sensitive film is Fujifilm Thermoscale® Tactile Surface Temperature Indicating Film. These products are available from Sensor Products, Inc., having a location in Madison, N.J. A thermochromic film or paint material may also be used on the test shell as a color-changing material.

Figure 13:
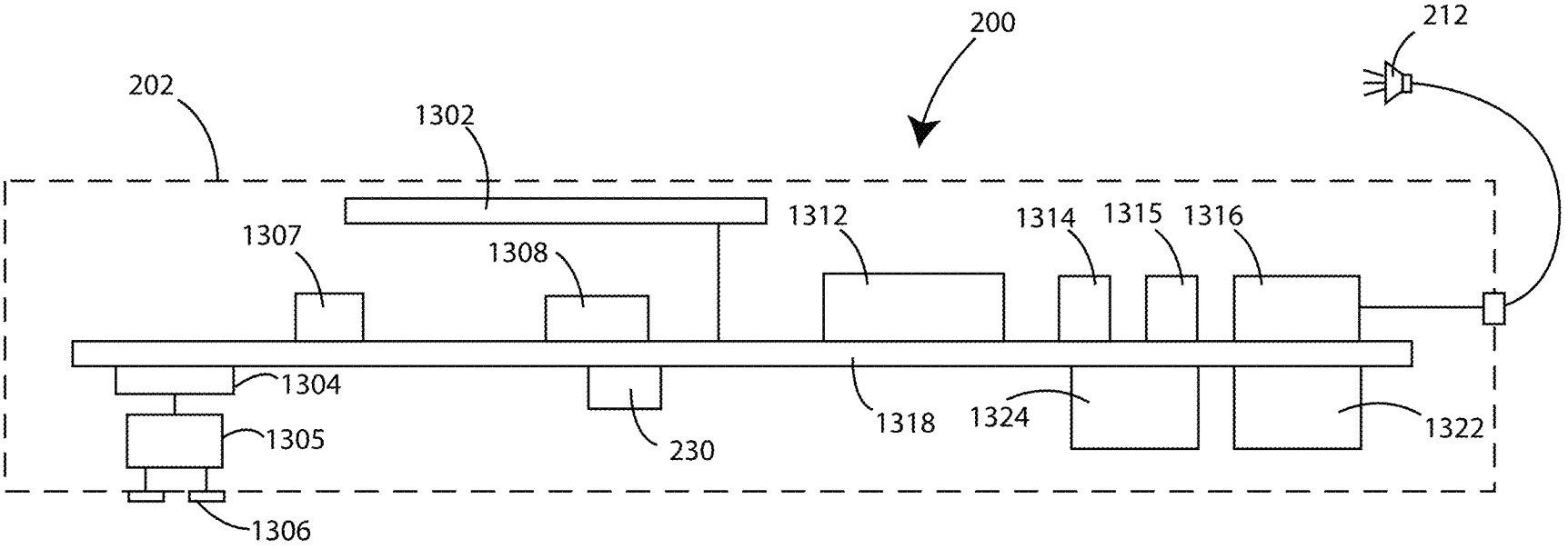
FIG. 13 is a schematic view of various components of an ear-wearable device in accordance with various embodiments herein.

Schematic of Internal Components of Ear-Wearable Device (FIG. 13)

Referring now to FIG. 13, a schematic block diagram is shown with various components of an ear-wearable device 200 in accordance with various embodiments. These components are enclosed within the housing 202 of the ear-wearable device with is formed by the faceplate and the test shell. The block diagram of FIG. 13 represents a generic ear-wearable device for purposes of illustration. The ear-wearable device 200 shown in FIG. 13 includes several components electrically connected to a flexible mother circuit 1318 (e.g., flexible mother board) which is disposed within housing 202. A power supply circuit 1304 can include a battery 1305, can be electrically connected to the flexible mother circuit 1318, and provides power to the various components of the ear-wearable device 200. In some embodiments, one or more charging contacts 1306 are connected to the battery 1305 and are configured to interface with the charging contacts of the charging case. In other embodiments, the charting contacts are not present and the battery 1305 is replaced when exhausted.

One or more microphones 1307 are electrically connected to the flexible mother circuit 1318, which provides electrical communication between the microphones 1307 and a digital signal processor (DSP) 1312. Among other components, the DSP 1312 incorporates or is coupled to audio signal processing circuitry configured to implement various functions described herein. One or more user input devices 230 (e.g., on/off, volume, mic directional settings) are electrically coupled to the DSP 1312 via the flexible mother circuit 1318.

A sensor package 1314 can be coupled to the DSP 1312 via the flexible mother circuit 1318. The sensor package 1314 can include one or more different specific types of sensors. The ear-wearable device includes an ear-wearable device IMU 1315. The IMU 1315 is configured to detect a vibration sequence as a part of a pairing method for the wireless communication device 1308, among other useful data that can be ascertained from IMU 1315.

As used herein the term "inertial measurement unit" or "IMU" shall refer to an electronic device that can generate signals related to a body's specific force and/or angular rate. IMUs herein can include one or more accelerometers (3, 6, or 9 axis) to detect linear acceleration, a gyroscope to detect rotational rate, or both. In some embodiments, in the alternative or in addition, an IMU includes a magnetometer to detect a magnetic field.

An audio output device 1316 is electrically connected to the DSP 1312 via the flexible mother circuit 1318. In some embodiments, the audio output device 1316 comprises a speaker (coupled to an amplifier). In other embodiments, the audio output device 1316 comprises an amplifier coupled to a receiver 212 adapted for positioning within an ear of a wearer. The receiver 212 can include an electroacoustic transducer, speaker, or loudspeaker.

The ear-wearable device 200 may incorporate a wireless communication device 1308 coupled to the flexible mother circuit 1318 and to an antenna 1302 directly or indirectly via the flexible mother circuit 1318. The communication device 1308 can be a high-frequency radio, such as a 2.4 GHz radio. The radio can conform to an IEEE 802.11 (e.g., WiFi®) or a Bluetooth® (e.g., Bluetooth® low energy, Bluetooth® 4. 2 or 5.0, and Bluetooth® Long Range) specification, for example. It is understood that ear-wearable devices of the present disclosure can employ other radios, such as a 900 MHz radio.

Ear-wearable devices of the present disclosure can be configured to receive streaming audio (e.g., digital audio data or files) from an electronic or digital source. Ear-wearable devices herein can also be configured to switch communication schemes to a long-range mode of operation, wherein, for example, one or more signal power outputs may be increased, and data packet transmissions may be slowed or repeated to allow communication to occur over longer distances than that during typical modes of operation. Representative electronic/digital sources (also serving as examples of accessory devices herein) include an assistive listening system, a TV streamer, a radio, a smartphone, a cell phone/entertainment device (CPED), a pendant, wrist-worn device, or other electronic device that serves as a source of digital audio data or files.

The communication device 1308 can be configured to communicate with one or more external devices, such as a wireless communication device of a charging case, a wireless communication device of another ear-wearable device, a wireless communication device of a smart phone, or a wireless communication device of another system, such as other systems discussed herein, in accordance with various embodiments. In various embodiments, the communication device 1308 can be configured to communicate with an external visual display device such as a smart phone, a video display screen, a tablet, a computer, or the like.

In various embodiments, the ear-wearable device 200 can also include a control circuit 1322 and a memory storage device 1324. The control circuit 1322 can be in electrical communication with other components of the device. The control circuit 1322 can execute various operations, such as those described herein. The control circuit 1322 can include various components including, but not limited to, a microprocessor, a microcontroller, an FPGA (field-programmable gate array) processing device, an ASIC (application specific integrated circuit), or the like. The memory storage device 1324 can include both volatile and non-volatile memory. The memory storage device 1324 can include ROM, RAM, flash memory, EEPROM, SSD devices, NAND chips, and the like. The memory storage device 1324 can be used to store data from sensors as described herein and/or processed data generated using data from sensors as described herein, including, but not limited to, information regarding exercise regimens, performance of the same, visual feedback regarding exercises, and the like.

It is noted that the structure and housing of a second ear-wearable device is not illustrated herein but may be similar to or identical to the first ear-wearable device.

Ear-wearable devices of the present disclosure can incorporate an antenna arrangement coupled to a high-frequency radio, such as a 2.4 GHz radio. The radio can conform to an IEEE 802.11 (e.g., WiFi® standard) or Bluetooth® standard (e.g., BLE, Bluetooth® 4. 2 or 5.0) specification, for example. It is understood that ear-wearable devices of the present disclosure can employ other radios, such as a 900 MHz radio. Ear-wearable devices of the present disclosure can be configured to receive streaming audio (e.g., digital audio data or files) from an electronic or digital source. Representative electronic/digital sources (also referred to herein as accessory devices) include an assistive listening system, a TV streamer, a radio, a smart phone, a cell phone/entertainment device (CPED) or other electronic device that serves as a source of digital audio data or files.

Figure 15:
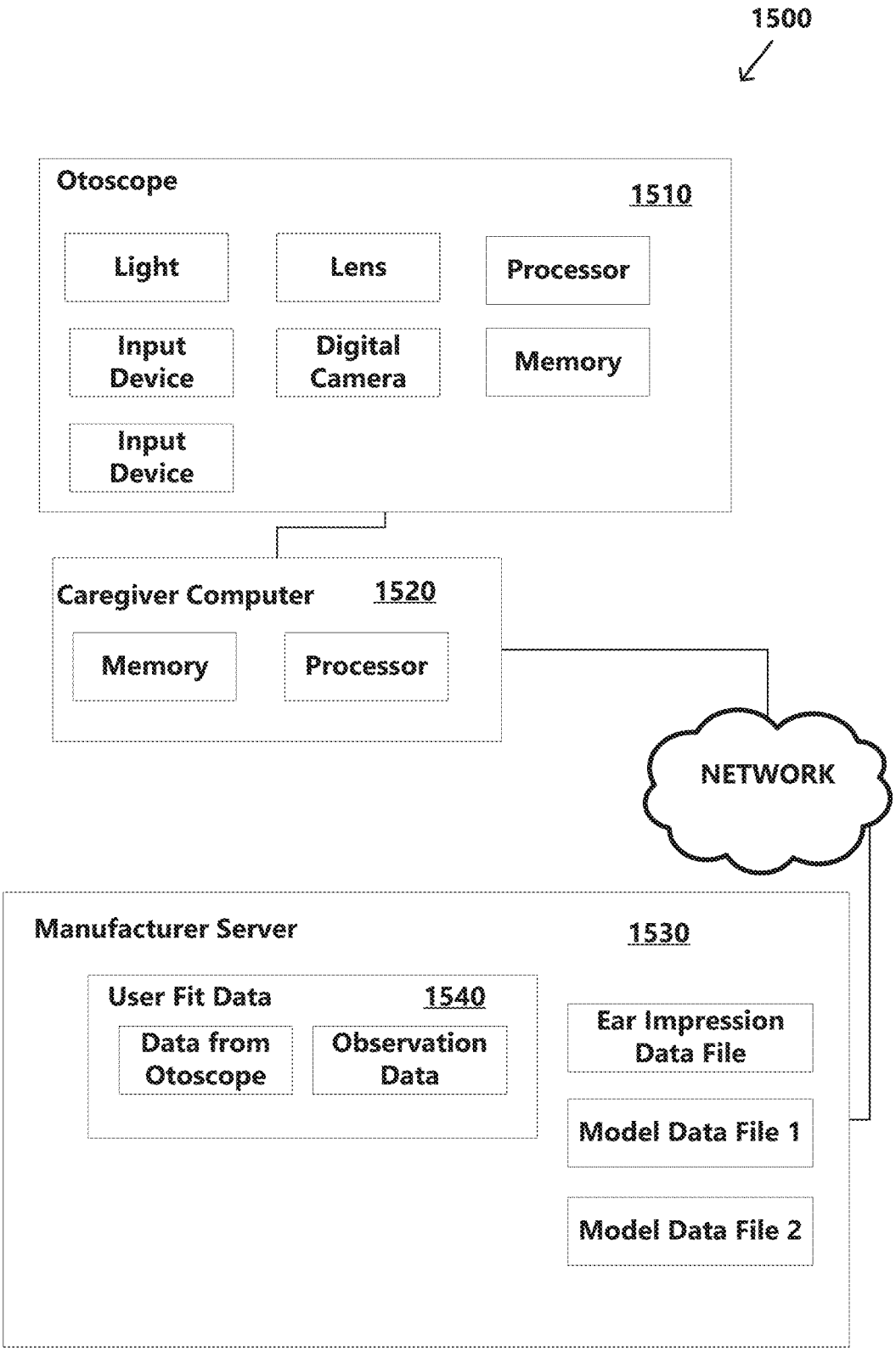
FIG. 15 is a schematic drawing of storage locations and hardware for collecting data related to test shells and evaluation of test shells.

Hardware and Storage Location Examples (FIG. 15)

FIG. 15 is a schematic drawing of storage locations and hardware for collecting data related to test shells and evaluation of test shells. The system 1500 illustrated in FIG. 15 is one example of components for a method of fitting a user with an ear-wearable device. An otoscope 1510 can be located at a caregiver's office and can include a light, a lens, and a digital camera. The otoscope can also include a processor, a memory, and one or more input devices for operating the light, the digital camera, and other aspects of the otoscope. While the user is at the caregiver's location, the otoscope 1510 can be used to shine light in a cavity of a test shell while the caregiver observes the fit in the user's ear. The otoscope 1510 can also be used to record still or video images of the test shell within the user's ear. The otoscope 1510 is connected to a caregiver computer 1520 having a memory and a processor. The images collected by the otoscope 1510 can be stored on the caregiver computer. Caregiver and user observation data can also be stored in the memory of the caregiver computer.

The caregiver computer 1520 is in communication with a manufacturer server 1530 via a network. The manufacturer server 1530 also has a memory and one or more processors. The manufacturer server 1530 stores many different types of data related to the fitting process for a particular user, and for many users, including an ear impression data file, a first model data file, and a second, reworked model data file. The manufacturer server 1530 can store user fit data 1540 including data from the otoscope 1510 and observation data from the caregiver and patient. As a result of this data being collected by the caregiver and being accessible on the manufacturing server, the data can be used by personnel of the manufacturer in the construction of a final shell for the user. The personnel of the manufacturer are provided with a rich source of data about the fit to use in constructing the final shell, while the user only needs to interact with the caregiver. In many situations, the caregiver office location is distant from the manufacturer location.

It should be noted that, as used in this specification and the appended claims, the singular forms "a," "an," and "the" include plural referents unless the content clearly dictates otherwise. It should also be noted that the term "or" is generally employed in its sense including "and/or" unless the content clearly dictates otherwise.

It should also be noted that, as used in this specification and the appended claims, the phrase "configured" describes a system, apparatus, or other structure that is constructed or configured to perform a particular task or adopt a particular configuration. The phrase "configured" can be used interchangeably with other similar phrases such as arranged and configured, constructed and arranged, constructed, manufactured and arranged, and the like.

All publications and patent applications in this specification are indicative of the level of ordinary skill in the art to which this invention pertains. All publications and patent applications are herein incorporated by reference to the same extent as if each individual publication or patent application was specifically and individually indicated by reference.

As used herein, the recitation of numerical ranges by endpoints shall include all numbers subsumed within that range (e.g., 2 to 8 includes 2.1, 2.8, 5.3, 7, etc.).

The headings used herein are provided for consistency with suggestions under 37 CFR 1.77 or otherwise to provide organizational cues. These headings shall not be viewed to limit or characterize the invention(s) set out in any claims that may issue from this disclosure. As an example, although the headings refer to a "Field," such claims should not be limited by the language chosen under this heading to describe the so-called technical field. Further, a description of a technology in the "Background" is not an admission that technology is prior art to any invention(s) in this disclosure. Neither is the "Summary" to be considered as a characterization of the invention(s) set forth in issued claims.

The embodiments described herein are not intended to be exhaustive or to limit the invention to the precise forms disclosed in the following detailed description. Rather, the embodiments are chosen and described so that others skilled in the art can appreciate and understand the principles and practices. As such, aspects have been described with reference to various specific and preferred embodiments and techniques. However, it should be understood that many variations and modifications may be made while remaining within the spirit and scope herein.

The invention claimed is:

1. A system for assessing fit in an ear of a user of an ear-wearable device, the system comprising:

an impression of the user's ear, the impression comprising an impression material;

a test shell, wherein the test shell is created using the impression of the user's ear, the test shell comprising:

a body comprising an aperture end and an ear canal end, wherein the aperture end defines a first aperture, wherein the body defines a shell cavity extending away from the first aperture in a direction of the ear canal end;

wherein the body comprises a transparent or translucent material;

wherein the body is sized to fit within an ear of the user of an ear-wearable device;

wherein, when the test shell is placed within the ear of the user, goodness of fit of the test shell in the user's ear is evaluated by visual inspection.

2. The test shell of claim 1 wherein the body comprises a light-sensitive material, wherein the light-sensitive material displays, when exposed to light, a visual contrast to a human eye between test shell portions contacting the user's ear and test shell portions not contacting the user's ear when illuminated.

3. The test shell of claim 2 wherein the light-sensitive material is sensitive to visual light, ultraviolet light, or infrared light.

4. The test shell of claim 1 further comprising an indication of ear anatomy of the user on a surface of the test shell.

5. The test shell of claim 1 wherein the ear canal end defines a second aperture, wherein the shell cavity extends from the first aperture to the second aperture.

6. The test shell of claim 1 wherein the body comprises acrylic, UV cured acrylic, polyurethane, or glass.

7. The test shell of claim 1 wherein the body comprises a material having a light transmission percentage of about 85% or more.

8. The test shell of claim 1 wherein the body comprises a body wall having a thickness of 0.2 millimeter or more and 1.5 millimeter or less.

9. The test shell of claim 1 wherein the body comprises a material having a tensile strength of at least about 55 megapascals.

10. The test shell of claim 1 wherein the body comprises a pressure-sensitive color changing material that changes color in response to pressure and is present on an exterior surface of test shell.

11. A method of fitting a user with an ear-wearable device comprising:

creating an impression of the user's ear using an impression material;

creating a test shell using the impression, wherein the test shell comprises a body comprising an aperture end and an ear canal end, wherein the aperture end defines a first aperture, wherein the body defines a shell cavity extending away from the first aperture in a direction of the ear canal end, wherein the body comprises a transparent or translucent material, wherein the body is sized to fit within an ear of the user of an ear-wearable device;

placing the test shell into the user's ear;

illuminating the test shell, while the test shell is in the user's ear, using a light source placed within the shell cavity; and visually inspecting the test shell, while the test shell is in the user's ear, using a light source to evaluate goodness of fit of the test shell in the user's ear.

12. The method of claim 11 further comprising the steps of:

recording a first user observation at a first-time regarding goodness of fit during moving by the user, wherein the user observations comprise comfort, discomfort, locations of discomfort, occlusion, lack of occlusion, or locations of lack of occlusion; and creating a final shell for an ear-wearable device using the first user observation and using information recorded based on visually inspecting the test shell.

13. The method of claim 12 further comprising recording a second user observation at a second time, wherein the second time is at least one day later than the first time, wherein creating the final shell further comprises using the second user observation.

14. The method of claim 12 further comprising:

moving by the user comprising chewing, talking, walking, swallowing or yawning by the user;

wherein recording the first user observation takes place after moving by the user.

15. The method of claim 11 further comprising constructing a final shell for the ear-wearable device using information recorded based on visually inspecting the test shell.

16. The method of claim 11 further comprising capturing an image of the shell cavity of the test shell when the test shell is in the user's ear.

17. The method of claim 11 further comprising:

moving by the user, while the test shell is in the user's ear, comprising chewing, talking, walking, swallowing or yawning by the user;

visually inspecting, while the test shell is in the user's ear, the test shell during the moving by the user; and recording a first user observation regarding goodness of fit during moving by the user, wherein the first user observation comprises an observation regarding comfort, discomfort, locations of discomfort, occlusion, lack of occlusion, or locations of lack of occlusion.

18. The method of claim 17 further comprising video recording of the shell cavity of the test shell, while the test shell is in the user's ear, during moving by the user.

19. The method of claim 11 wherein the test shell and the final shell are made of material having a tensile strength of at least about 55 megapascals.

20. A system for assessing fit in an ear of a user of an ear-wearable device, the system comprising:

an impression of the user's ear, the impression comprising an impression material;

a test shell, wherein the test shell is created using the impression of the user's ear, the test shell comprising:

a body comprising an aperture end and an ear canal end, wherein the aperture end defines a first aperture, wherein the body defines a shell cavity extending away from the first aperture in a direction of the ear canal end;

wherein the body comprises a transparent or translucent material;

wherein the body comprises a color-changing material that changes color in response to pressure or temperature; and wherein the body is sized to fit within an ear of the user of an ear-wearable device.

* * * * *